US011673410B2

(12) United States Patent
Amir et al.

(10) Patent No.: US 11,673,410 B2
(45) Date of Patent: Jun. 13, 2023

(54) ROTARY PRINTER FOR TEXTILES

(71) Applicant: Kornit Digital Ltd., Rosh HaAyin (IL)

(72) Inventors: Nuriel Amir, Yokneam Ilit (IL); Ohad Snir, Kiryat-Ono (IL); Maor Meir Avner, Reut Maccabim Modiin (IL)

(73) Assignee: Kornit Digital Ltd., Rosh HaAyin (IL)

( * ) Notice: Subject to any disclaimer, the term of this patent is extended or adjusted under 35 U.S.C. 154(b) by 387 days.

(21) Appl. No.: 16/762,195

(22) PCT Filed: Nov. 7, 2018

(86) PCT No.: PCT/IL2018/051200

§ 371 (c)(1),
(2) Date: May 7, 2020

(87) PCT Pub. No.: WO2019/092712

PCT Pub. Date: May 16, 2019

(65) Prior Publication Data

US 2020/0262216 A1 Aug. 20, 2020

Related U.S. Application Data

(60) Provisional application No. 62/582,347, filed on Nov. 7, 2017, provisional application No. 62/582,336, filed on Nov. 7, 2017.

(51) Int. Cl.
*B41J 3/407* (2006.01)
*B41F 17/00* (2006.01)
(Continued)

(52) U.S. Cl.
CPC ..... *B41J 3/4078* (2013.01); *B41F 17/005* (2013.01); *B41J 11/0021* (2021.01); *B41J 11/04* (2013.01)

(58) Field of Classification Search
CPC .. B41J 13/223; B41J 13/226; B41J 2025/008; B41J 11/04; B41J 3/4078; B41J 3/4073
See application file for complete search history.

(56) References Cited

U.S. PATENT DOCUMENTS 5,148,746 A 9/1992 Fuller et al.
2013/0340484 A1* 12/2013 Turner ..... B41F 16/02 28/165

(Continued)

FOREIGN PATENT DOCUMENTS

CN 86103720 2/1987
CN 86103720 A * 12/1987

(Continued)

OTHER PUBLICATIONS

Yue, MachineTranslationof-CN-206067227-U, 2017 (Year: 2017).*

(Continued)

*Primary Examiner* — Scott A Richmond

(57) ABSTRACT

A printing machine for printing fabrics on a rotary drum, comprises one or more drums rotatable about a drum axis, that receive tubes of fabric thereon, and a print head placed in proximity to the drum, to print onto the fabric fitted onto the drum. The print head comprises multiple printing nozzles or linear arrays of printing nozzles which are aligned linearly along the axial direction of the drum, which are all at a predefined printing distance from the drum surface or the fabric surface. Also, a rotary drum for a textile printer comprises a groove extending along the length of the drum, and a catch mechanism built into the groove for catching on to a garment or backing for a garment as the drum rotates. The rotation of the drum pulls the caught edge and wraps the garment around the drum ready for rotary drum printing.

11 Claims, 29 Drawing Sheets

(51) Int. Cl.
*B41J 11/00* (2006.01)
*B41J 11/04* (2006.01)

(56) References Cited

U.S. PATENT DOCUMENTS

| | | | | |
|---|---|---|---|---|
| 2014/0299009 | A1 | 10/2014 | Miller et al. | |
| 2016/0136949 | A1* | 5/2016 | Kojima | B41J 2/04503 347/8 |
| 2017/0239961 | A1 | 8/2017 | Turner | |
| 2018/0065379 | A1* | 3/2018 | Ohnishi | B41J 3/4078 |

FOREIGN PATENT DOCUMENTS

| | | | | |
|---|---|---|---|---|
| CN | 101722723 | A * | 6/2010 | |
| CN | 202271649 | | 6/2012 | |
| CN | 104379353 | | 2/2015 | |
| CN | 104827750 | | 8/2015 | |
| CN | 105121170 | | 12/2015 | |
| CN | 206067227 | | 4/2017 | |
| CN | 206067227 | U * | 4/2017 | |
| CN | 107618273 | | 1/2018 | |
| CN | 108215525 | | 6/2018 | |
| JP | 10-058661 | | 3/1998 | |
| WO | WO-2014207103 | A1 * | 12/2014 | B05D 1/26 |
| WO | WO 2015/107380 | | 7/2015 | |
| WO | WO 2019/092712 | | 5/2019 | |
| WO | WO 2019/092712 | A9 | 5/2019 | |

OTHER PUBLICATIONS

Liang, MachineTranslationof-CN-101722723-A, 2010 (Year: 2010).*
Zhang, MachineTranslationof-CN-86103720-A, 1987 (Year: 1987).*
Supplementary Partial European Search Report and the European Search Opinion dated Jun. 30, 2021 From the European Patent Office Re. Application No. 18875389.1. (127 Pages).
Supplementary European Search Report and the European Search Opinion dated Oct. 4, 2021 From the European Patent Office Re. Application No. 18875389.1 (9 Pages).
International Preliminary Report on Patentability dated May 22, 2020 From the International Bureau of WIPO Re. Application No. PCT/IL2018/051200. (10 Pages).
International Search Report and the Written Opinion dated Feb. 21, 2019 From the International Searching Authority Re. Application No. PCT/IL2018/051200. (19 Pages).

* cited by examiner

Fig. 1A (Not Claimed)

ROTARY PRINTER FOR TEXTILES

RELATED APPLICATIONS

This application is a National Phase of PCT Patent Application No. PCT/IL2018/051200 having International filing date of Nov. 7, 2018, which claims the benefit of priority under 35 USC § 119(e) of U.S. Provisional Patent Application Nos. 62/582,336 and 62/582,347, both filed on Nov. 7, 2017. The contents of the above applications are all incorporated by reference as if fully set forth herein in their entirety.

FIELD AND BACKGROUND OF THE INVENTION

The present invention, in some embodiments thereof, relates to a rotary printer for textiles and more particularly but not exclusively to textiles made into tubes, including seamless textiles, and also to the printing of flat textiles on such a rotary printer.

The textiles, also referred to as fabrics, may be based on any conventional or unconventional textile material. The fabric may for example comprise felt, leather, fibrous materials, porous materials, materials having high surface tension with the ink liquid, weaves of natural and synthetic fibers, weaves of mixtures of natural and synthetic fibers, natural fibers including wool, cotton, linen and synthetic fibers including nylon or suede. The fabric is essentially planar with smaller fibers, hairs, extending outwardly from the plane.

Textiles may often be sewn into tubes, for example to make socks. In addition textile tubes may be seamless. Thus seamless textiles are textiles ready woven into tube shapes so that there is no need to add a seam down the side when making a garment. Instead of connecting two ends together to make a closed side the textile is initially manufactured as a tube. The tubes are particularly in demand for use in women's underwear that is intended for wearing underneath tight clothing. Seams may be visible as protruding lines through the tight clothing and such protrusions are considered unsightly. Seamless underwear based on textile tubes is probably the most comfortable of a number of solutions marketed to deal with the problem, and may include whole body garments.

Of course seamless textiles are not restricted to underwear but may be used for other kinds of garments as well. Unfortunately however tube fabrics are difficult to print on a standard textile printer. It is possible to place the item to be printed, either in tube form or as the finished underwear or clothing, on a flat tray of the kind used for printing a tee-shirt and such an arrangement can be used to print a picture or a slogan on one side. The item may then be reversed for printing on the other side if desired. However it is not possible to print all around the tube or provide an image or pattern that is continuous around the tube using a flat tray or pallet. Nevertheless it is desirable to print a continuous image or pattern to emphasize the seamless nature of the resulting garment. Rotary printers or drum printers are used to print garments in tube form, such as socks, bodysuits and the like. The rotary printers allow for continuous printing around the tube whereas flat printers tend to produce discontinuities.

Non-tubular garments, that is garments in open shapes, such as shirts, are not easily fitted on a drum, and thus flat printing with discontinuities is unavoidable. Closing the garment by doing up the buttons does not help as the closure is not strong enough and the buttons are likely to burst and in any case, may lead to creases, especially on the edges of the garment beyond the reach of the final button.

SUMMARY OF THE INVENTION

The present embodiments relate to a drum-based printing device for printing tubes of fabric, such as socks and seamless tubes, wherein the fabric tube is mounted on the drum. A print head has a series of nozzles which are aligned along an axial direction of the drum and the drum rotates to print an image or pattern on the garment. The drum may be exchanged with drums of different sizes without needing to readjust the nozzles, so that any size of tube garment from a toddler's sock to an adult's bodysuit or leotard, may be accommodated. Likewise there may be provided a series of drums which advance over the machine between loading positions and printing positions to provide high throughput. The drums may be arranged in a continuous belt or in a series of palettes or a series of pairs of palettes.

Furthermore, heating and curing following printing may be carried out while the fabric tubes remain mounted on the drums.

A flat garment such as a shirt has a backing inserted in such a way that an edge of the backing protrudes. A print drum has a groove that catches the protruding edge during rotation and pulls the backing, consequently wrapping the garment on the drum. The backing allows for tight mounting where the garment is not itself a closed tube and thus continuous all-round printing is possible of a non-tube garment.

In other words, a rotary drum for a textile printer comprises a groove extending along the length of the drum and a catch mechanism built into the groove for catching on to a garment or backing for a garment as the drum rotates. The rotation of the drum pulls the caught edge and wraps the garment around the drum ready for rotary drum printing.

According to an aspect of some embodiments of the present invention there is provided a printing machine for printing fabrics on a drum, the printing machine comprising:

at least one drum rotatable about a drum axis, the drum axis defining an axial direction along the drum, the drum configured to receive a tube of fabric thereon;

a first print head placed in proximity to a surface of the drum, to print onto the tube when the tube is fitted onto the drum; wherein the print head comprises a plurality of printing nozzles, the nozzles being aligned along the drum axial direction.

In an embodiment, the rotatable drums are interchangeable with other drums of different circumferences, and wherein the rotatable drums or the print head are adjustable to retain a predefined printing distance of the nozzles from the fabric irrespective of a circumference of a currently used drum or a thickness of the fabric.

An embodiment may be configured to print by rotating the drum while the print head is stationary or while the print head moves along the axial direction.

In an embodiment, the print head is controlled to print via a virtual printing image that is cylindrical.

In an embodiment, the cylindrical printing image is formed by wrapping an image into the cylinder so that the image is continuous.

An embodiment may comprise a plurality of print heads, and in an example, the print heads may have a linear nozzle array for each color being printed.

An embodiment may comprise at least one pretreatment nozzle for providing pre-treatment fluid to the fabric prior to printing.

An embodiment may comprise at least one post-treatment nozzle or post treatment nozzle array for post treatment of the fabric after printing. Alternatively or additionally the printing head further includes a radiation source to provide a curing beam.

In an embodiment, the at least one post treatment nozzle or post treatment nozzle array provides to the fabric at least one of a softener, a curing compound, a stabilizing compound and a coating compound.

An embodiment may comprise at least one additional print head comprising nozzles axially aligned with the drum in parallel with the first print head, the additional print head being at a same radial distance from the drum as the first print head and.

An embodiment may comprise an additional print head located opposite an end of the drum.

An embodiment may comprise a wrinkle detector located in front of the nozzles in a direction in which the fabric approaches the nozzles, the wrinkle detector being configured to stop printing if a protruding fold or wrinkle extending from the fabric is detected approaching the nozzles that is big enough to cause blockage of one of the nozzles.

An embodiment may comprise a plurality of rotating drums, and/or a palette of rotating drums.

An embodiment may comprise the rotating drums arranged in pairs, each pair sharing an axis of rotation.

An embodiment may comprise pairs of palettes, each pair of palettes sharing respective axes of rotation.

An embodiment may include a print-head-bearing bridge for each of the axes of rotation, the print-head-bearing bridge allowing a single print-head to service drums of multiple palettes. In an embodiment, at least one of the print-head-bearing bridges bears a plurality of print-heads.

In an embodiment, one palette of at least one pair of palettes is in a loading position for loading fabrics while a second palette of the at least one pair is in a printing position.

Embodiments may include a drier unit for drying the fabrics after printing, and the drums or the palettes with the drums mounted thereon, and the fabrics on the drums, may be inserted into the drying unit.

Embodiments may comprise a second print head over the at least one drum at an angle radially separated from the first print head, nozzles of the second print head being axially aligned along the drum.

Embodiments may comprise modular units combined together, wherein each unit has one member of the group consisting of one drum, one pair of drums, one palette of drums and one pair of palettes of drums.

Embodiments may comprise a secondary drum, arranged at a preset distance from the first drum, to hold a given fabric taut between the two drums.

According to a second aspect of the present invention there is provided a method of printing a fabric tube comprising:

fitting the fabric tube over a first drum;

rotating the first drum over a plurality of rotations; and carrying out printing using nozzles arranged axially along the first drum.

The method may comprise advancing the nozzles axially along the drum following ones of the rotations, or advancing the nozzles axially along the drum during ones of the rotations.

The method may comprise selecting from a plurality of drums having different circumferences to find a best fit for a given fabric tube.

The method may comprise adjusting the nozzles for each drum circumference to provide a predetermined printing distance between the nozzles and the fabric tube.

The method may comprise controlling the print head to print via a virtual printing image that is cylindrical.

The method may comprise forming the cylindrical printing image by wrapping an image into the cylinder so that the image is continuous.

The method may comprise detecting for wrinkles in fabric of the tube approaching the nozzles and upon detection of a wrinkle above a predetermined size, stopping printing.

The method may comprise adding a pretreatment compound to the fabric prior to printing.

In an embodiment, the pretreatment is one or more of wetting, fixation, and pH balancing.

Embodiments may comprise adding a post-treatment compound to the fabric after printing.

In an embodiment, the post-treatment is one or more of softening, coating and curing.

Embodiments may comprise providing curing radiation to the fabric.

Embodiments may comprise providing a plurality of drums for the printing.

Embodiments may comprise arranging the plurality of drums in pairs, each pair sharing an axis of rotation.

Embodiments may comprise arranging the plurality of drums in pairs on palettes, and inserting each palette independently for printing.

Embodiments may comprise arranging two or more of the palettes to share one or more axes of rotation, providing each axis of rotation with a print-head bearing bridge, and providing each print-head-bearing bridge with one or more print-heads with axially-aligned nozzles.

Embodiments may comprise printing over an end of at least one of the cylinders with an additional print head.

The method may comprise placing a secondary drum at a predetermined distance from the first drum, the predetermined distance selected to hold a fabric taut between the primary and secondary drums for printing.

According to a third aspect of some embodiments of the present invention there is provided a rotary drum for a textile printer, the drum having a radius, first and second ends of round cross section and a length extending between the ends, the drum comprising a groove extending along the length and the groove comprising a catch for catching on to a garment or backing for a garment, to wrap the garment around the drum during rotation of the drum.

In an embodiment, the catch is a directional catch, designed to allow easy entry of an edge of the garment or backing when approaching in a rotation direction and preventing exit of the edge when receding in the rotation direction.

In an embodiment, the groove comprises a proximal edge and a distal edge, the proximal edge arriving first in the rotation direction, and wherein the proximal edge recedes radially inwardly into a depth of the drum and the distal edge extends radially outwardly to extend beyond a circumference of the drum, thereby to form the directional catch.

In an embodiment, the distal edge is rounded to present an inward slope into the groove at a radial level of the circumference.

In an embodiment, the catch extends along a length of the groove.

An embodiment may include caps at the ends inserted over a garment wrapped around the drum or with elasticated bands inserted at the ends over the garment.

In an embodiment, the caps are elasticated to hold the garment firmly on the drum for printing.

According to a fourth aspect of the present invention there is provided a method of mounting a garment onto a rotary drum for printing comprising:

providing a rotary drum having a catch;

applying a backing or foil to the garment;

extending an edge of the backing or foil outwardly from the garment towards the drum;

rotating the drum to catch the edge and pull the garment via the edge to wrap around the drum.

The method may comprise inserting caps over ends of the drum over the garment following the wrapping on the drum.

The method may comprise printing onto the garment while the garment is wrapped on the drum.

According to a fifth aspect of the present invention there is provided a garment with a backing inserted therein and an edge protruding from the backing, the backing attached to the garment and the edge inserted into a groove in a print drum such that when the print drum rotates, the edge is pulled around the drum, and the garment is pulled with the edge.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the printing map from an original image can involve performing or completing selected tasks manually, automatically, or a combination thereof, and likewise control of the printer in general. Moreover, according to actual instrumentation and equipment of embodiments of the method and/or system of the invention, such tasks as image mapping and printing control may be implemented by hardware, by software or by firmware or by a combination thereof using an operating system.

For example, hardware for performing selected tasks according to embodiments of the invention such as image mapping and printing control, could be implemented as a chip or a circuit. As software, the tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 1A is a simplified diagram of an embodiment not claimed herein, in which nozzles of a printing head cross at right angles to the axis of a print drum, with the result that different nozzles are at different distances from the printing surface;

Figure 2:
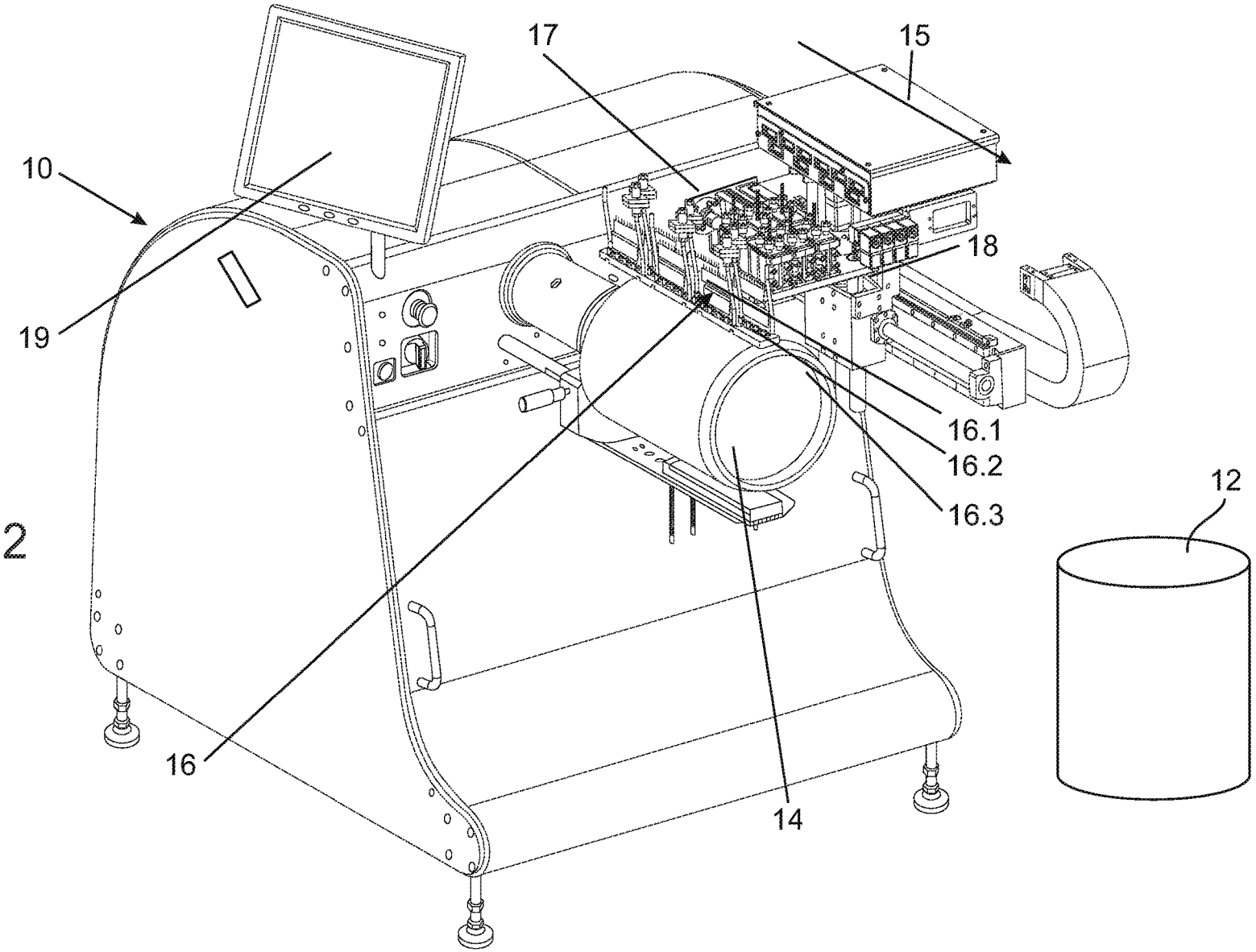
FIG. 2 is a simplified diagram of a printing machine according to the present embodiments with a single print drum and a print head with a linear nozzle array aligned along the axial direction of the print drum.
Figure 14:
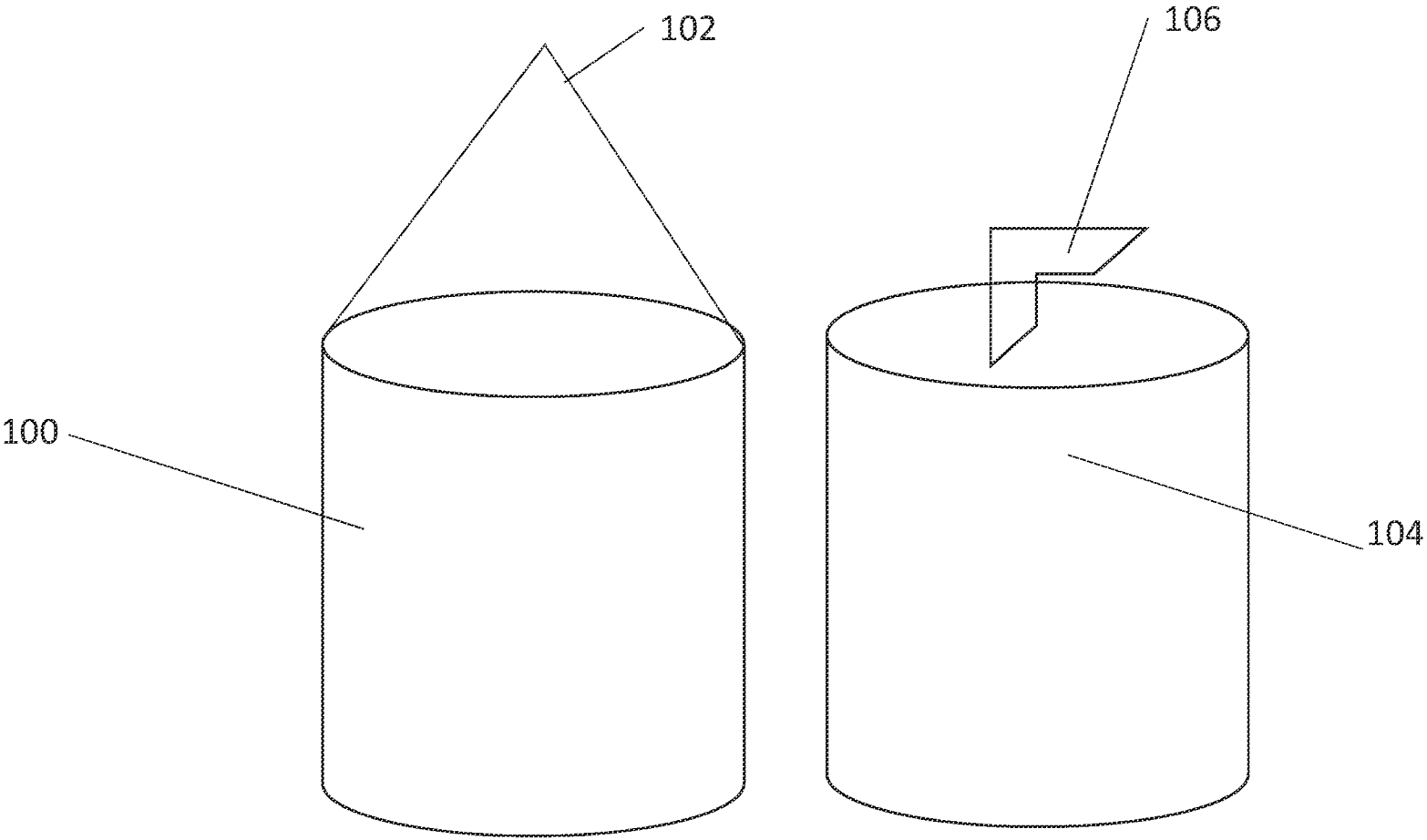
Figure 16:
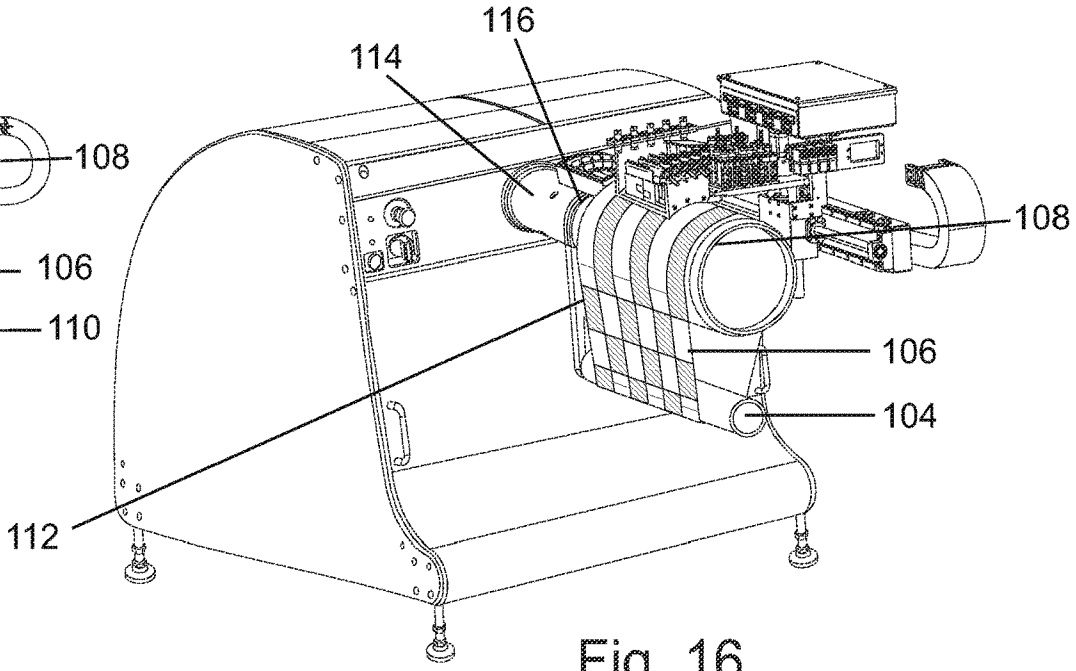
Figure 15:
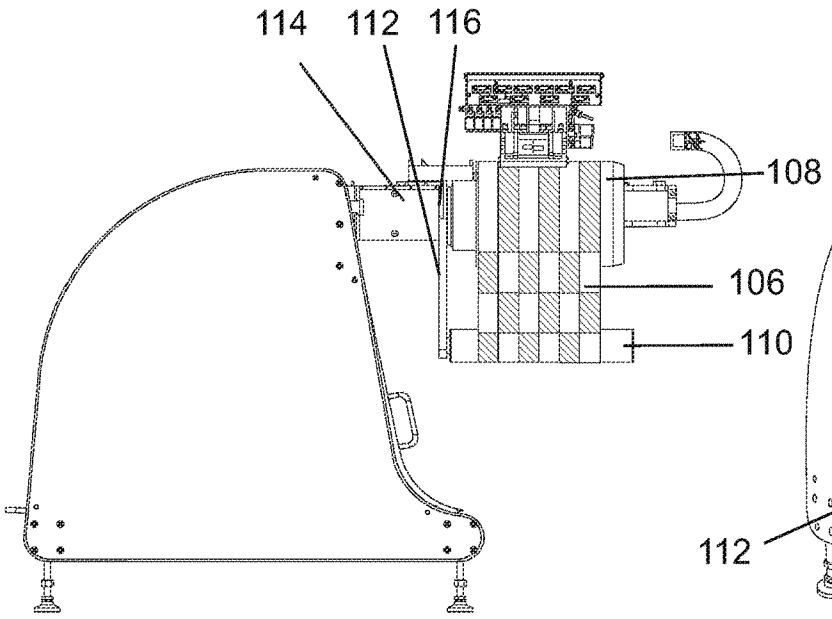
Figure 18:
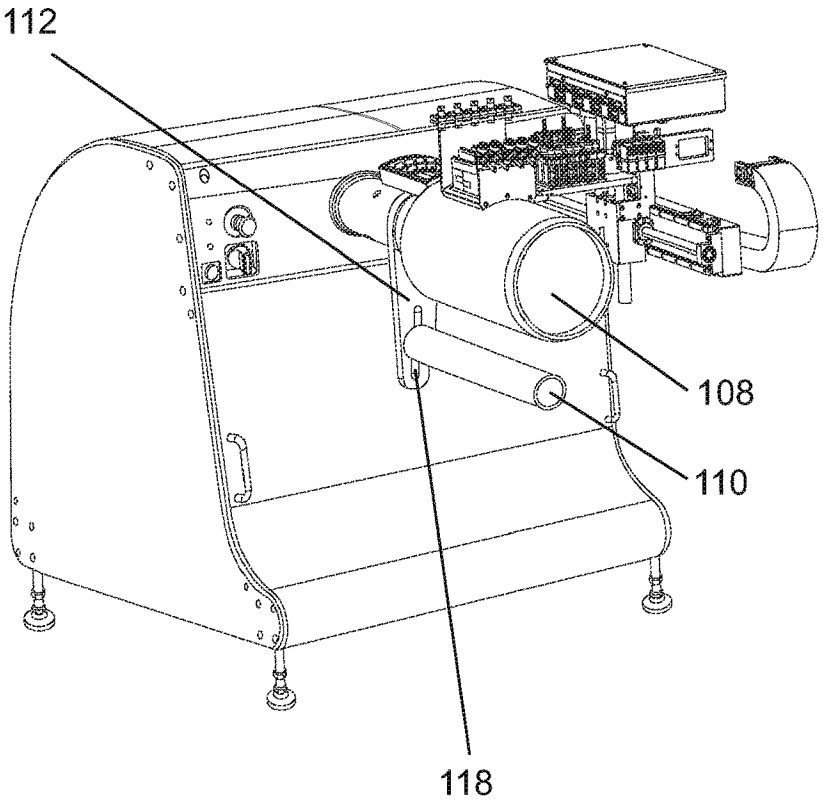
Figure 17:
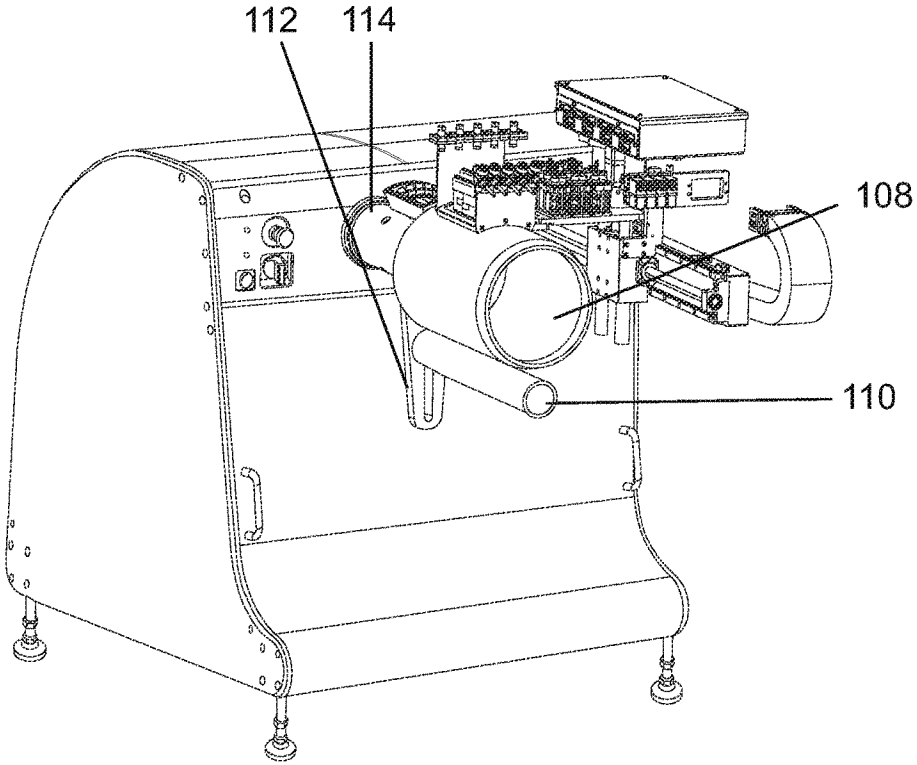
Figure 19:
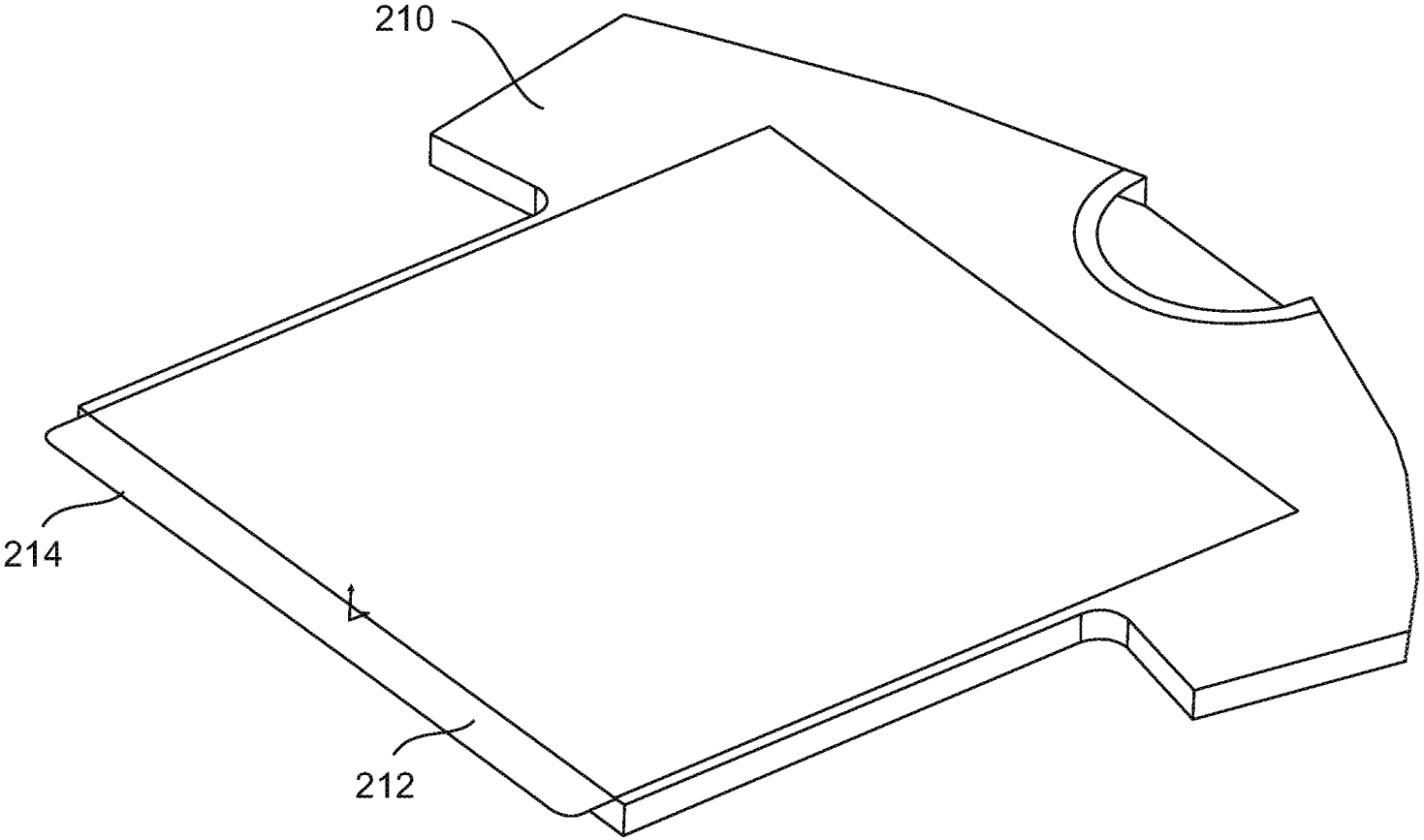
Figure 20:
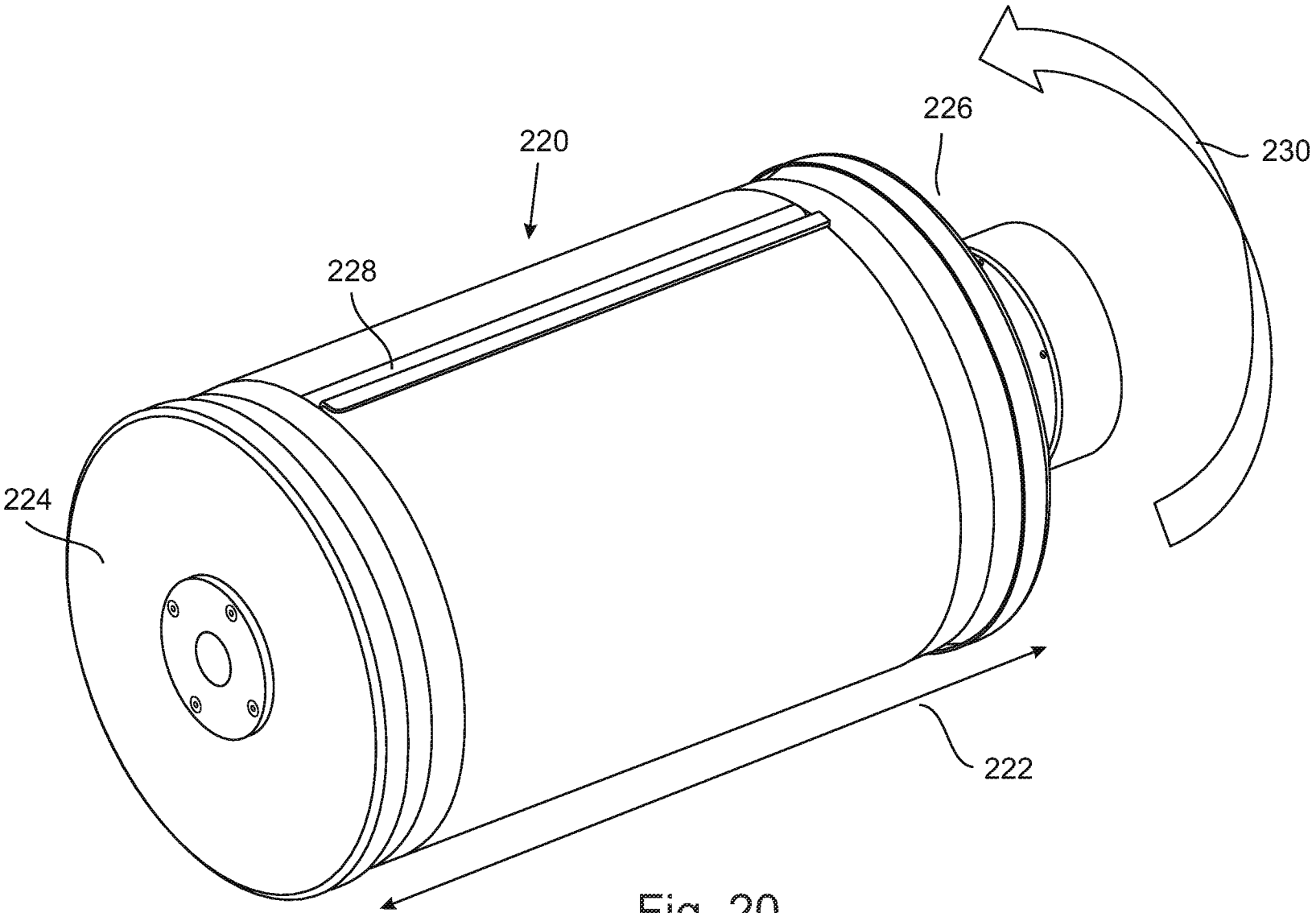
Figure 21:
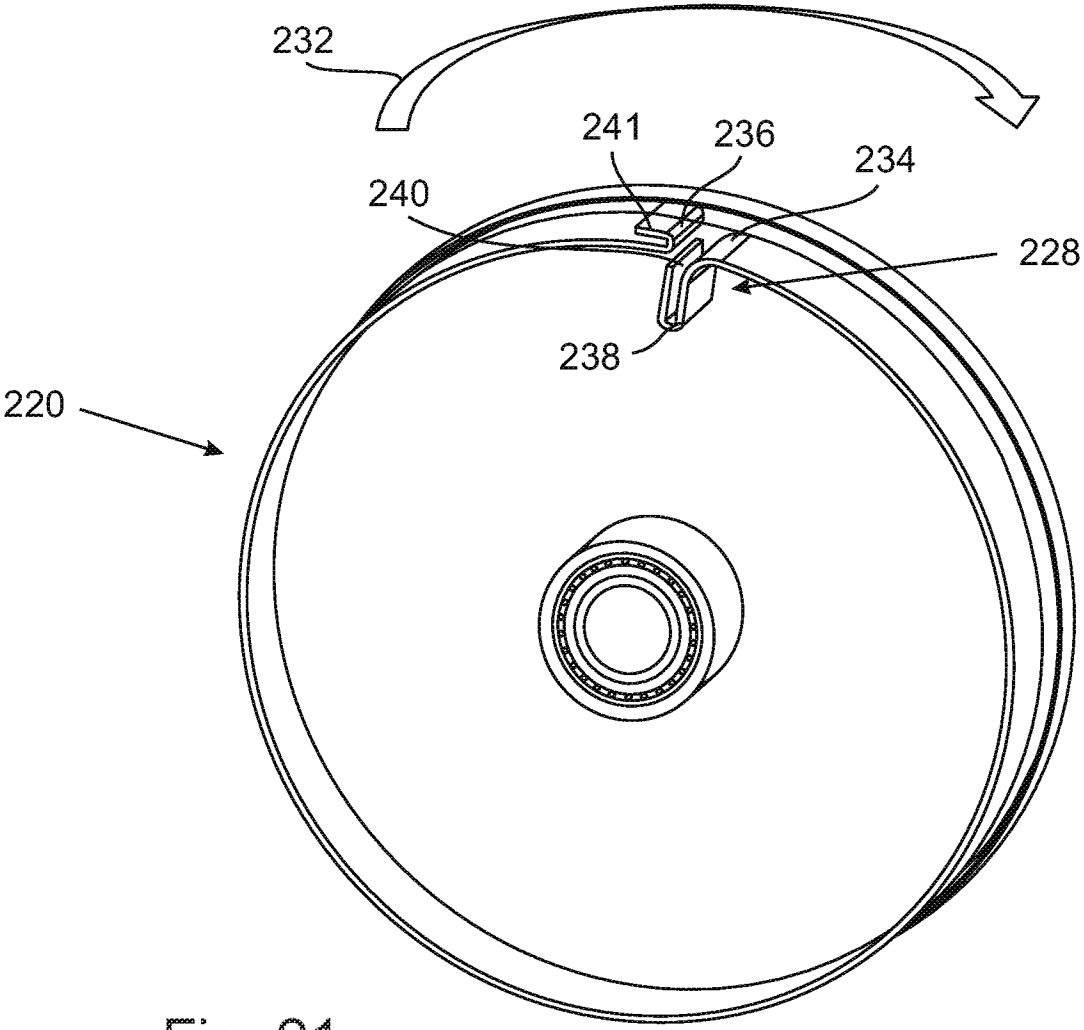
Figure 22:
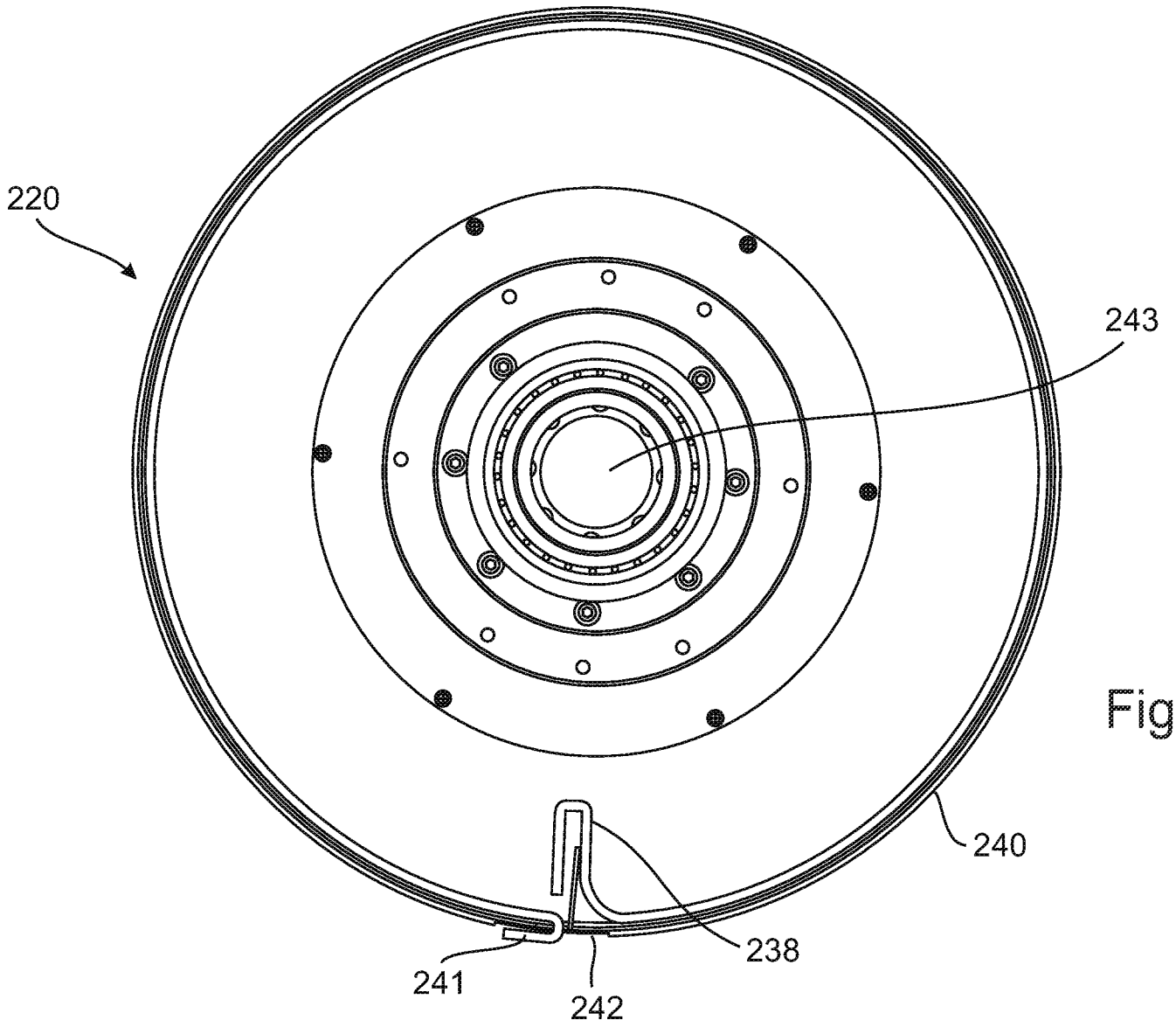
Figure 23:
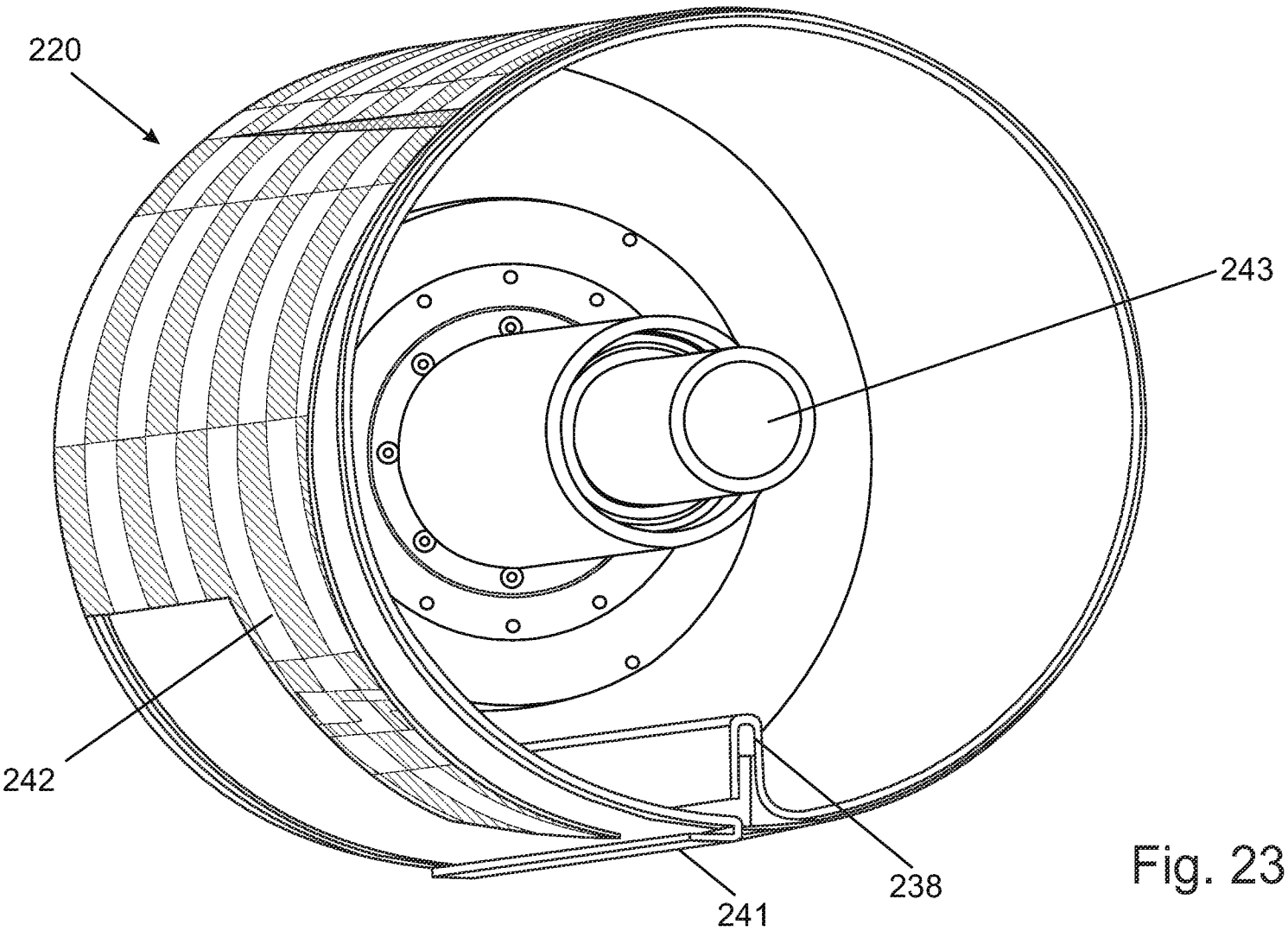
Figure 24:
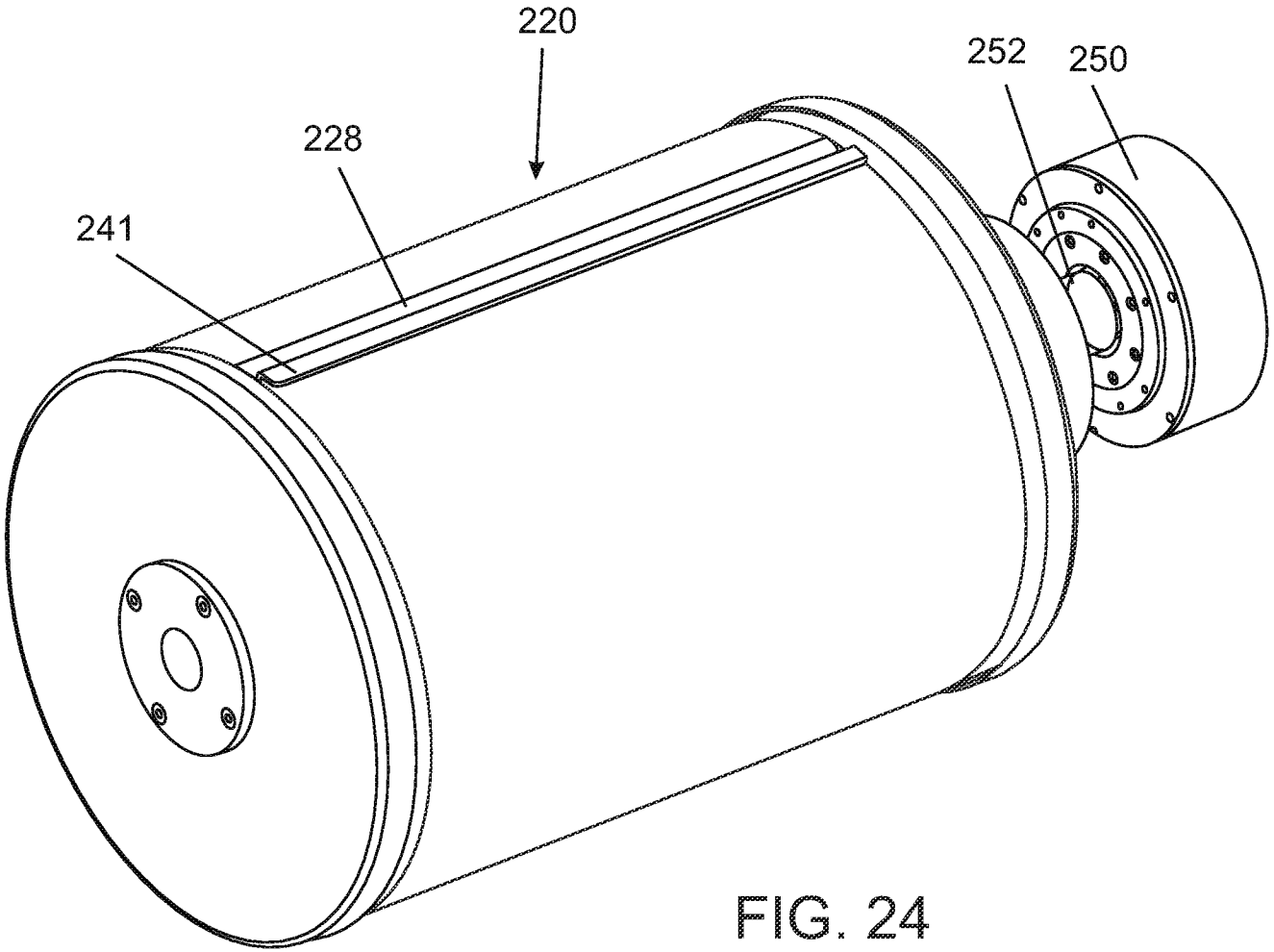
Figure 25:
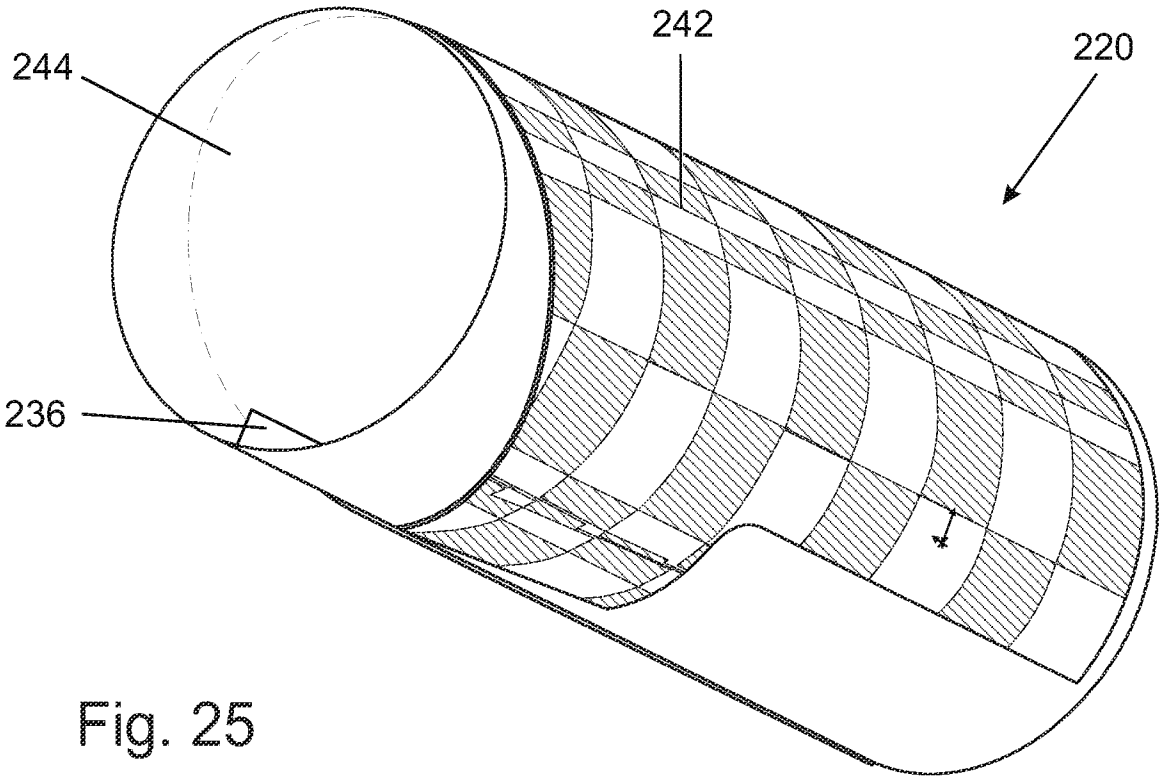
Figure 26:
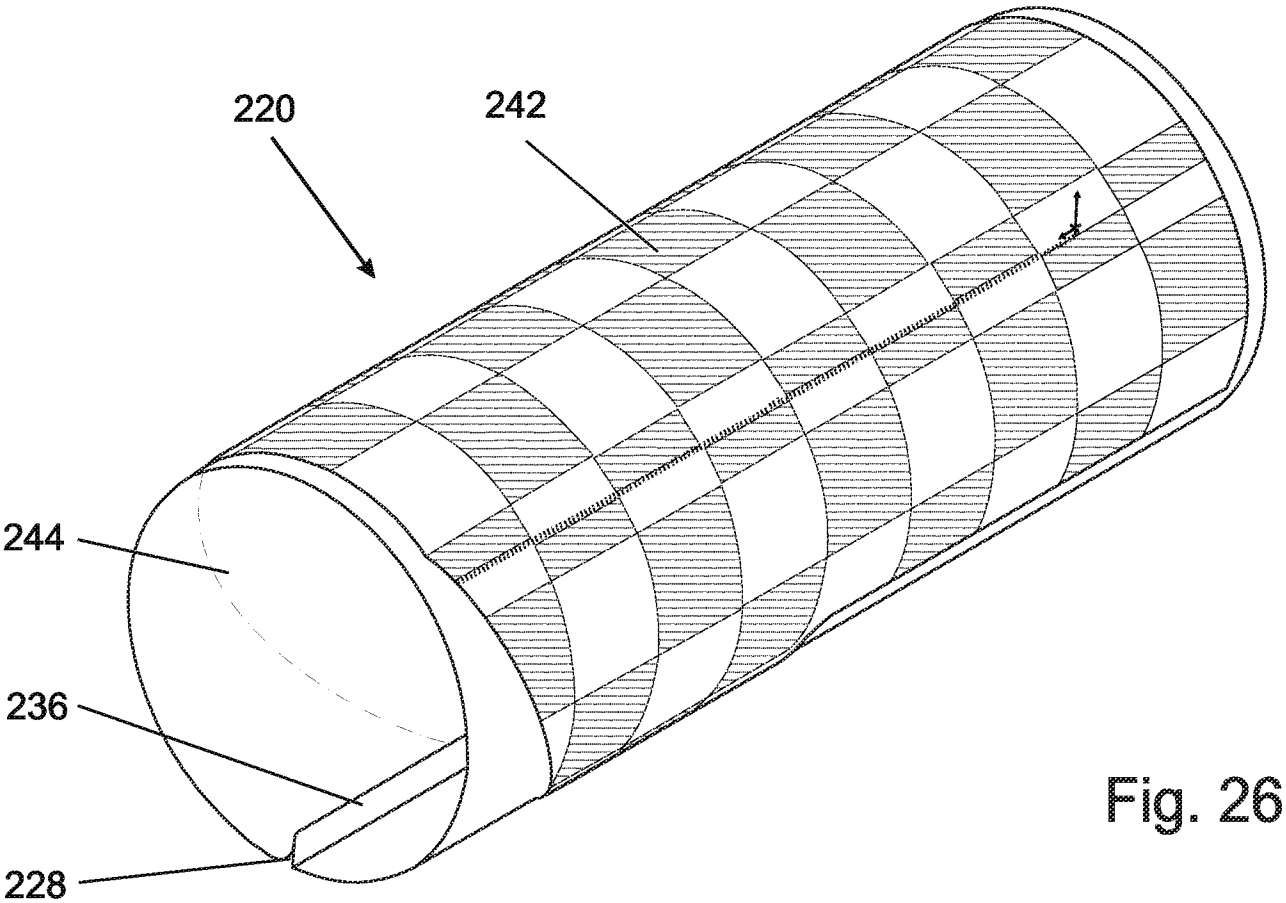
Figure 27:
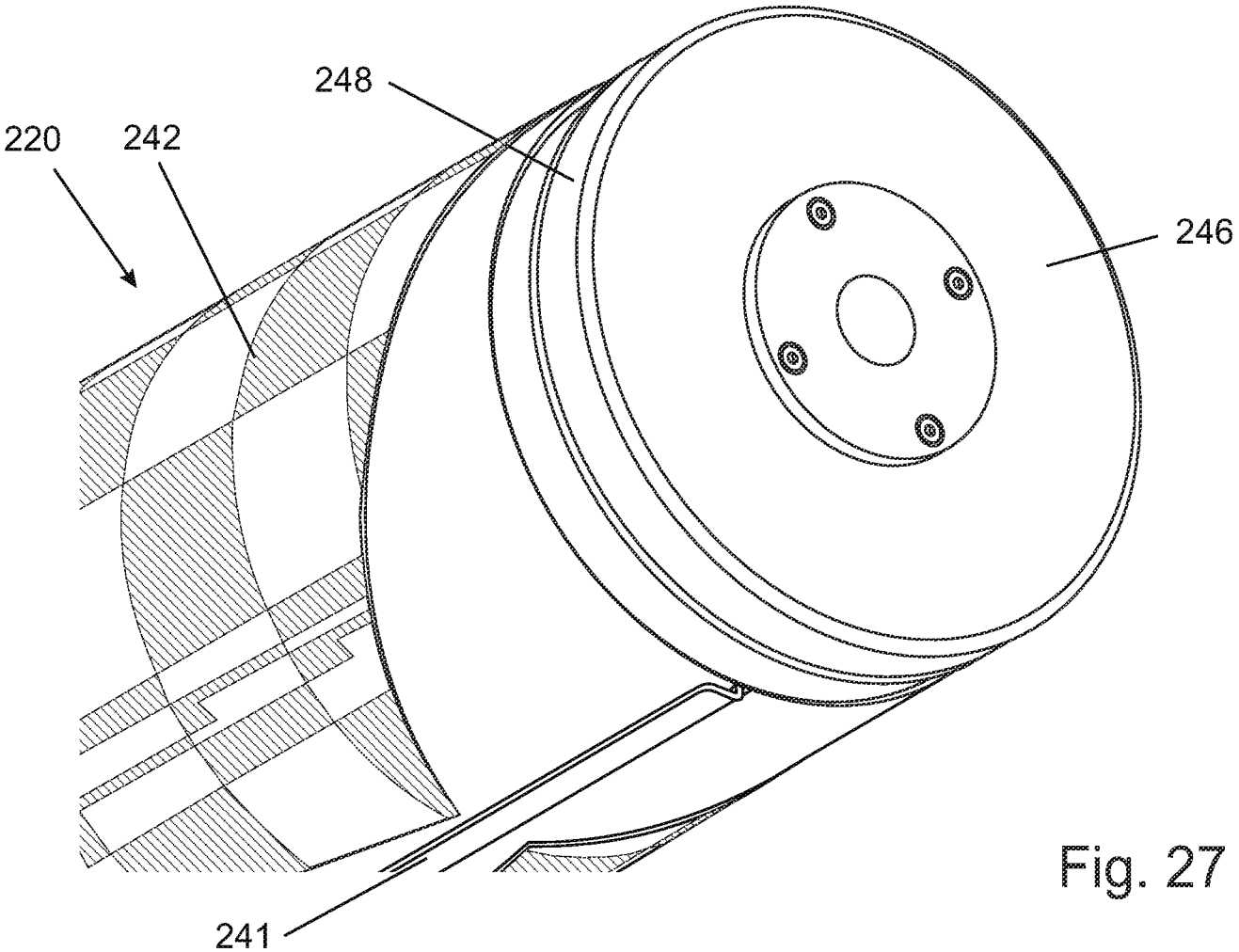
Figure 28:
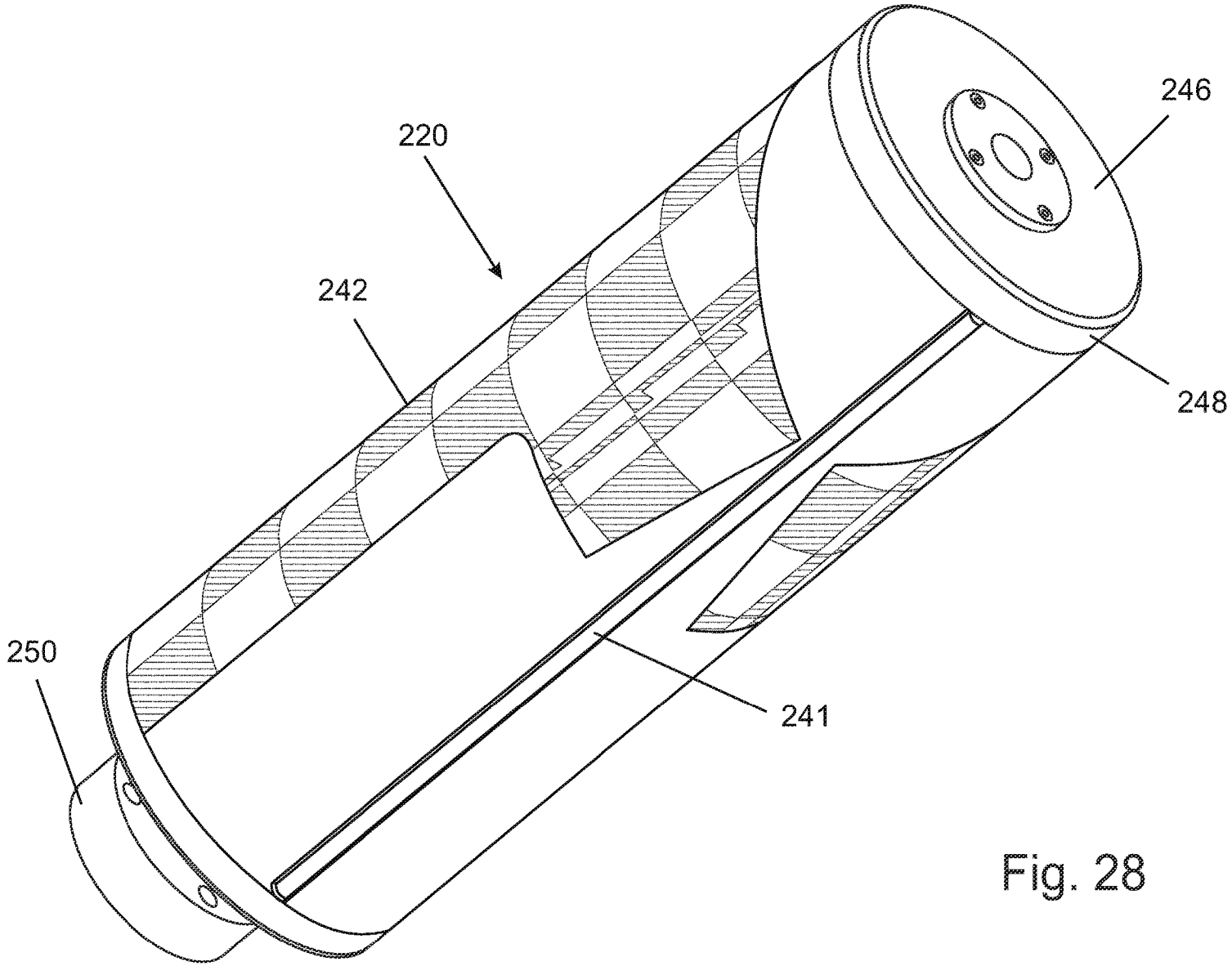
Figure 29:
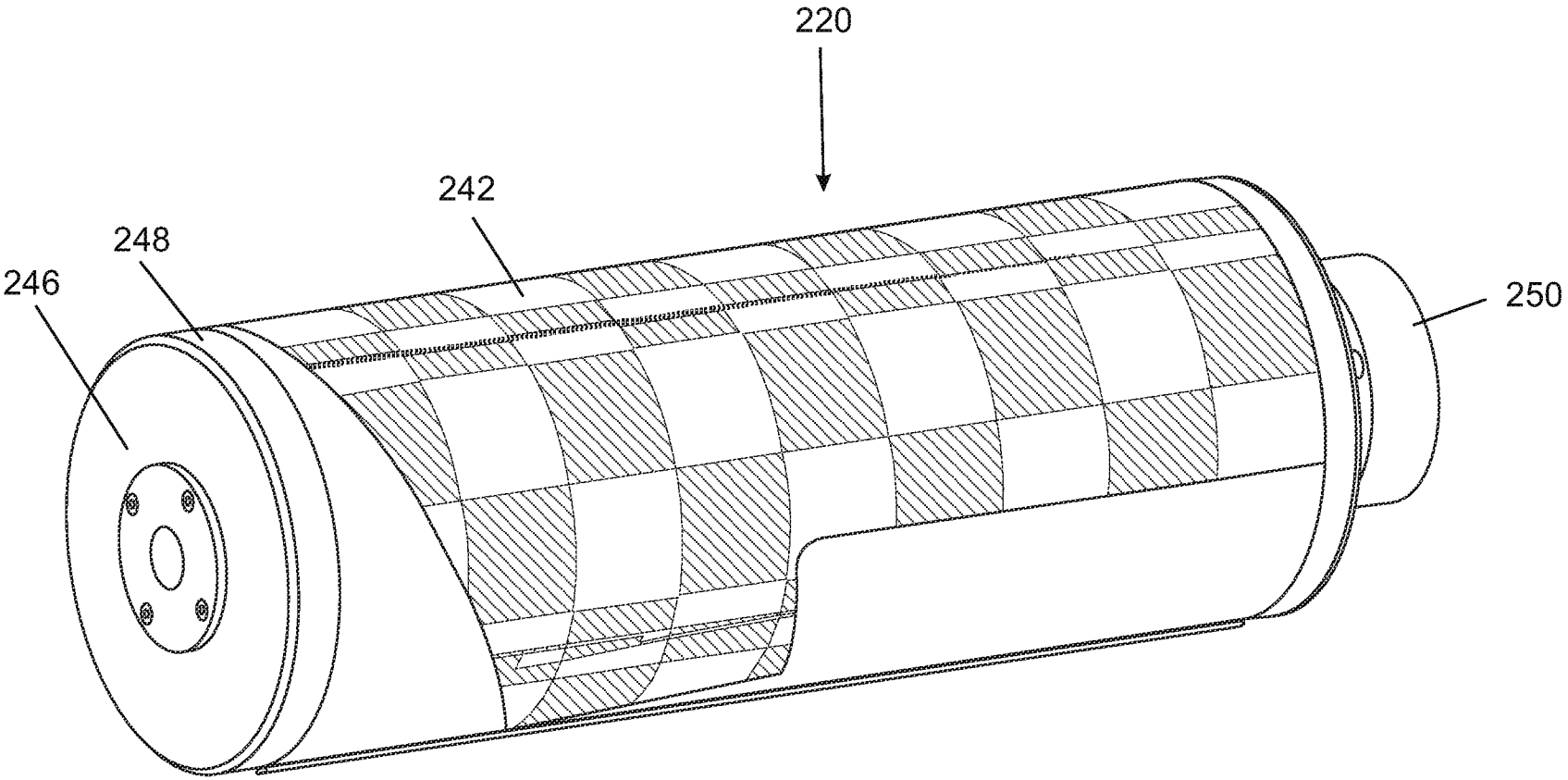
Figure 30:
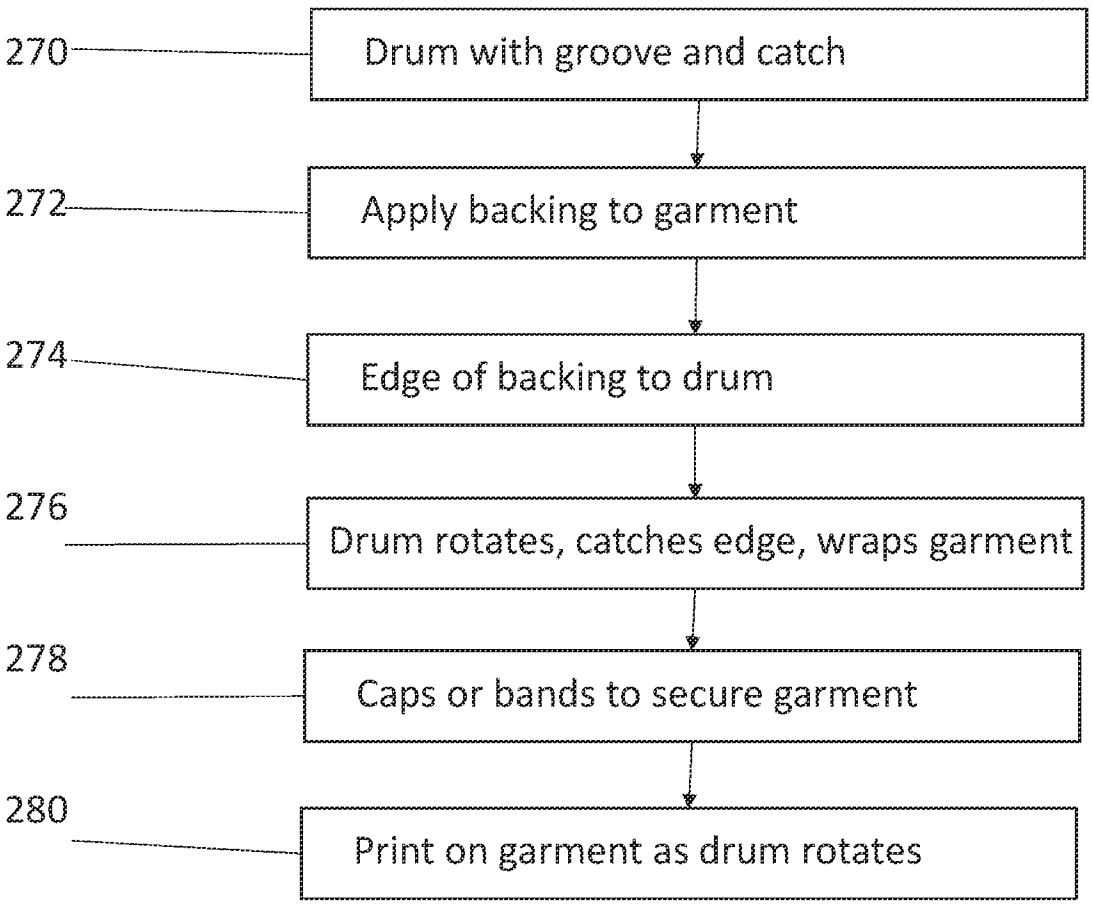

FIG. 14 is a simplified schematic diagram showing a variation of the machine of FIG. 2 having two drums side by side FIGS. 15 and 16 illustrate a further embodiment of the present invention in which a length of fabric is held taut between a primary drum and a secondary drum; and FIGS. 17 and 18 show the embodiment of FIGS. 15 and 16 with the fabric removed;

FIG. 19 is a simplified diagram showing a garment with an inserted foil for insertion onto a drum according to embodiments of the present invention;

FIG. 20 is a simplified diagram showing a perspective view of a drum with a groove according to embodiments of the present invention;

FIG. 21 is a simplified diagram showing a cutaway view of the drum of FIG. 20 with details of the catch mechanism within the groove;

FIG. 22 is a view from an open end into the interior of the drum of FIG. 20;

FIG. 23 is a simplified diagram showing a perspective view from an open side of a drum according to the present embodiments with a foil wrapped on the outside of the drum;

FIG. 24 is a view from a different perspective of the drum of FIG. 20;

FIG. 25 is a view of the drum of FIG. 20 with a foil wrapped thereon, open at one end and shown from a perspective point of view;

FIG. 26 is a view of the drum in FIG. 25 from a different perspective;

FIGS. 27 to 29 are views from various perspectives of the drum of FIG. 20 with a cap over the open end and a foil wrapped thereon; and FIG. 30 is a simplified flow chart showing operation of an embodiment of the present invention.

DESCRIPTION OF SPECIFIC EMBODIMENTS OF THE INVENTION

The present invention, in some embodiments thereof, relates to a rotary printer for textiles and more particularly but not exclusively to textiles made into tubes, including seamless textiles, and also printing of flat textiles on a rotary printer.

A printing machine according to the present embodiments, is designed to print onto fabrics on a rotary drum. The machine comprises one or more drums rotatable about a drum axis, that receive tubes of fabric thereon, and a print head placed in proximity to the drum, to print onto the fabric fitted onto the drum. The print head comprises multiple printing nozzles which are aligned linearly along the axial direction of the drum, which are all at a predefined printing distance from the drum surface or the fabric surface.

In the present embodiments, the print head may be located at a predetermined printing distance from the round surface of the drum or from the fabric and the height of the print head may be adjusted to keep the distance the same irrespective of different sized drums or different thicknesses of fabric. The drum has a series of nozzles, and the nozzles are arranged essentially in a line axially along the drum, so that the nozzles form a straight line. Since all the nozzles are on the same axial line, all the nozzles are practically at the same printing distance from the drum and remain at the same printing distance even if the drum is exchanged with another drum of a different size. Indeed very different size drums may be suitable for different garments. Thus a very small drum may be suitable for small children's socks, and a very large drum may be suitable for an adult's whole body garment.

In some embodiments, more than one print head may be applied to a single drum, with each head at a different radial angle around the drum. However the nozzles on each print head are lined up in the axial direction of the drum.

The print head may have separate nozzles or sets of nozzles for each color being printed, of which two, three or four colors are typical, and there may be one or more additional nozzles or sets of nozzles for pre-treatment and/or one or more additional nozzles for post treatment. Pre-treatment may include a wetting compound which may include components for balancing pH levels. Colors may for example be white with one color, white with multiple colors, or just the colors alone. In particular, dark fabrics may be provided with a white undercoat before printing other colors.

Post treatment may include softeners, stabilizing compounds, and coating and curing compounds. In addition or as an alternative, one or more radiation sources, LEDs lamps and the like, may provide suitable beams for curing, such as IR or UV beams.

The relative movement of the cylinder and the print head may be single pass, or a more complex scan including a spiral, depending on the resolution required.

The nozzles may be protected from blockage due to protruding bits of fabric by use of a wrinkle detector, that stops the printing process if a protruding fold or wrinkle of fabric is detected that is big enough to endanger the nozzles.

In addition to a single drum design, a dual drum design may be used, in which one or pairs of drums are used. Two or more drums may be axially aligned, in which case they may share a printing head. Alternatively, instead of the drums being individually mounted on the machine, the drums may be mounted on palettes, which are in turn mounted on the machine. Thus a palette with multiple drums may be used, and dual or multiple palettes may allow an operator to load one palette while a second palette is printing, to ensure continuity. One print head may service two side by side drums of which there may be several on each palette. The print heads may be carried on rails across bridges, so that there may be multiple bridges with one or more print heads per bridge. In the single print head per bridge scenario, the same print head may service drums on a second or further palettes as long as the drums line up axially. In the multiple print head per bridge scenario, an entire set of separate print heads may be provided for the parallel palette, for example if high throughput is required.

In addition, redundant carriages may be provided to cover for print head failures.

In one embodiment, the machine may be modular, with machine sections that can be built together to provide any required capacity level.

The fabrics may be dried while still on the drums. Thus no separate unloading and loading is required to remove the fabric from the printer to place in the drier. Rather the entire drum is removed. Where palettes are used, in the same way the entire palette may be inserted into the dryer with the fabric still on the drums. Thus the fabrics stand separately in the dryer for drying exposure to vacuum or hot air or dry air, and no separate loading steps are needed.

In a further embodiment, a print drum is designed with a lengthwise groove and a catch mechanism is built into the groove. A foil or backing is inserted into the garment, and an edge of the foil or backing protrudes. The protruding edge approaches the drum and, as the drum rotates, the protruding edge is caught in the groove and retained by the catch mechanism, dragging the garment in the direction of rotation and wrapping the garment on the drum. The garment may then be printed.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1A illustrates a drum 1 viewed end on, on which a fabric tube may be placed for printing. Print head 2 has nozzles or nozzle arrays 3 which extend across the drum from above in a straight line. As a result, each nozzle is at a different distance from the drum and the printing is not uniform, since the printing resolution reduces with distance from the nozzle.

Figure 1B:
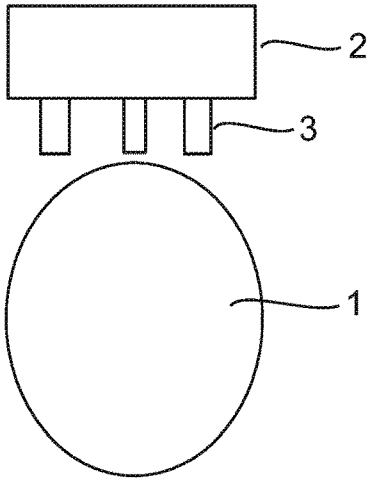
FIG. 1B is a simplified diagram illustrating a side view of an embodiment of the present invention, in which nozzles of the print head are aligned lengthwise along the axis of the print drum.
Figure 1B:
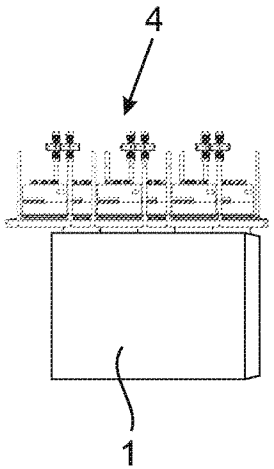

FIG. 1B is a schematic diagram showing a modification according to embodiments of the present invention in which the same print drum 1 is seen but this time side on. Print head 4 is a linear nozzle array in which nozzles line up along the axial direction of the drum. The linear nozzle array is a line of several hundred inkjet nozzles, and several linear arrays may be provided, say one for each color and others for pre and post treatment. All nozzle arrays are aligned along the axial direction of the drum and thus all are at approximately the same distance from the drum. It is added that even if the drum size is changed, the only adjustment that has to be made is to the relative height of the print head from the drum axis. All the nozzles may always be at the same distance from the drum.

Figure 1C:
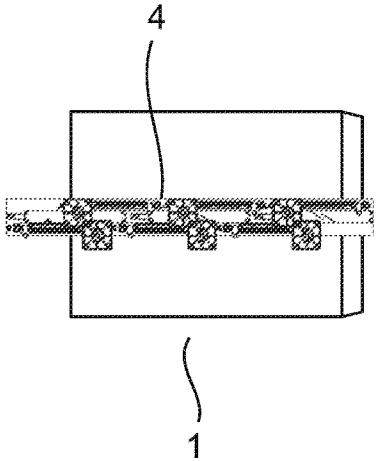
FIG. 1C is a view from above of the embodiment of FIG. 1B, showing a linear array of printing nozzles along the axial direction of the print drum.

FIG. 1C is a view from above of the arrangement of FIG. 1B. Linear nozzle array 4 is lined up along the axial direction of drum 1. As apparent from FIGS. 1B and 1C, the nozzles are all at the same distance from the printing drum. Three arrays may typically be used, for each of the three usual printing colors, and there may be a fourth array for black or white and further arrays for pre or post treatment fluids and of course more than three base colors may be used if desired.

Figure 1D:
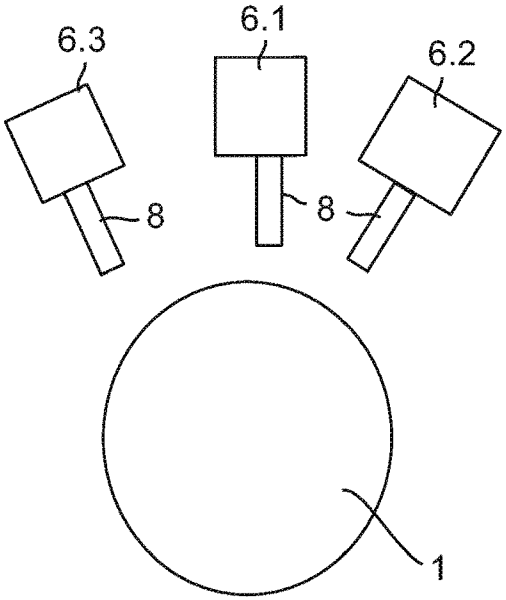
FIG. 1D is a view from the front of an alternative embodiment of the present invention in which three printing arrays with nozzles aligned along the axial direction of a print drum, are each located at different radial angles around the print drum.

Reference is now made to FIG. 1D, which illustrates an embodiment in which three separate linear printing arrays 6.1, 6.2 and 6.3 are provided at different angles to the drum. The print heads 6.1, 6.2 and 6.3 are of the kind shown in FIGS. 1B and 1C and a series of linear nozzle arrays 8 line up along the axial direction of the drum, all at the same distance from the drum surface. FIGS. 2 to 7 are six different perspective views that illustrate an exemplary printing machine 10 for printing of fabrics, in particular, textiles, made into socks or that are pre-woven into seamless tubes. Machine 10 is an exemplary machine that may carry one or more printing heads with nozzles or linear nozzle arrays of FIGS. 1B to 1D. Referring first to FIG. 2, and reference numeral 12 indicates a tube of fabric. The printing machine includes rotating drum 14, onto which the tube of fabric 12 is fitted. The drum 14 rotates and print head 16, generally an ink jet print head, is located in proximity to the drum and the fabric at a preset printing distance. As the drum spins, the nozzles spray pretreatment fluids, post treatment compounds and different colored inks onto the fabric. The print head 16 is mounted on bridge or arm 18 which is aligned with the longitudinal axis of the drum, generally referred to herein as the axial direction. In the course of printing the head 16 travels in and out along the arm to print circumferential lines around the tube 12 as the tube rotates with the drum. The print head 16 may be placed into relatively close proximity with the fabric, say within 1 to 2 mm or up to 10 mm, in order to achieve high definition printing. Alternatively the print head may move continually as it prints, thus scanning over the surface of the drum in a resultant motion which is helical. The travel is programmed so that each nozzle, or nozzle set for each color, passes over each portion of the printing area.

A touch-screen 19, or a conventional computer screen and keyboard may be used to control operation of the printing machine 10. Alternatively or additionally the machine may be remotely controlled via Bluetooth or infra-red or wire or Wifi, or by other computers connecting via LANs or via the Internet. Likewise, multiple machines may be controlled together.

As mentioned, the print head 16 may internally be made up of multiple linear nozzle arrays 16.1, 16.2 and 16.3 each including hundreds of inkjet nozzles and extending along the axial direction of the drum as shown in FIG. 1C. Each array may be dedicated to a different color. There may be one nozzle or nozzle set for each of the primary colors used in printing as well as one or more additional nozzles for a pretreatment fluid and one or more additional nozzles for post-treatment compounds. Since all of the nozzles are at the same angle around the drum, each of the nozzles are at the same predetermined distance from the surface of the fabric simply as a result of being aligned with each other. The predetermined distance may be fixed for the machine or may be set individually for the desired printing definition or fabric type.

Typically, tubes 12 may be of different sizes, in order to provide different sizes of clothing. Thus different sizes of drum are provided to make good fits for printing the different sizes of tubes. In general, socks and seamless clothing are made of easily stretchable fabrics so that a small number of drums can cater for a wide range of sizes. Nevertheless, sizes from toddler's socks to large adult body suits and leotards may be catered for. The drums may thus be removable and exchangeable with drums of other sizes. However, when the drum is changed the printing head may require repositioning to give the predetermined printing distance. That is to say the print head height is adjustable for the different drum sizes.

In one embodiment a print carriage 17, which carries the print head 16, is mounted to move in the direction of arrow 15. The print head may be moved higher or lower on the carriage to accommodate different sizes of drum and also to accommodate different thicknesses of fabric. Another option is to move the drum axis horizontally.

Printing is typically carried out by rotating the drum 14 during relative motion of the print head up and down along the axis of the drum along the support arm 18. As an alternative to adjusting the height of the head along the carriage, the arm may be raised or lowered on some embodiments.

Figure 3:
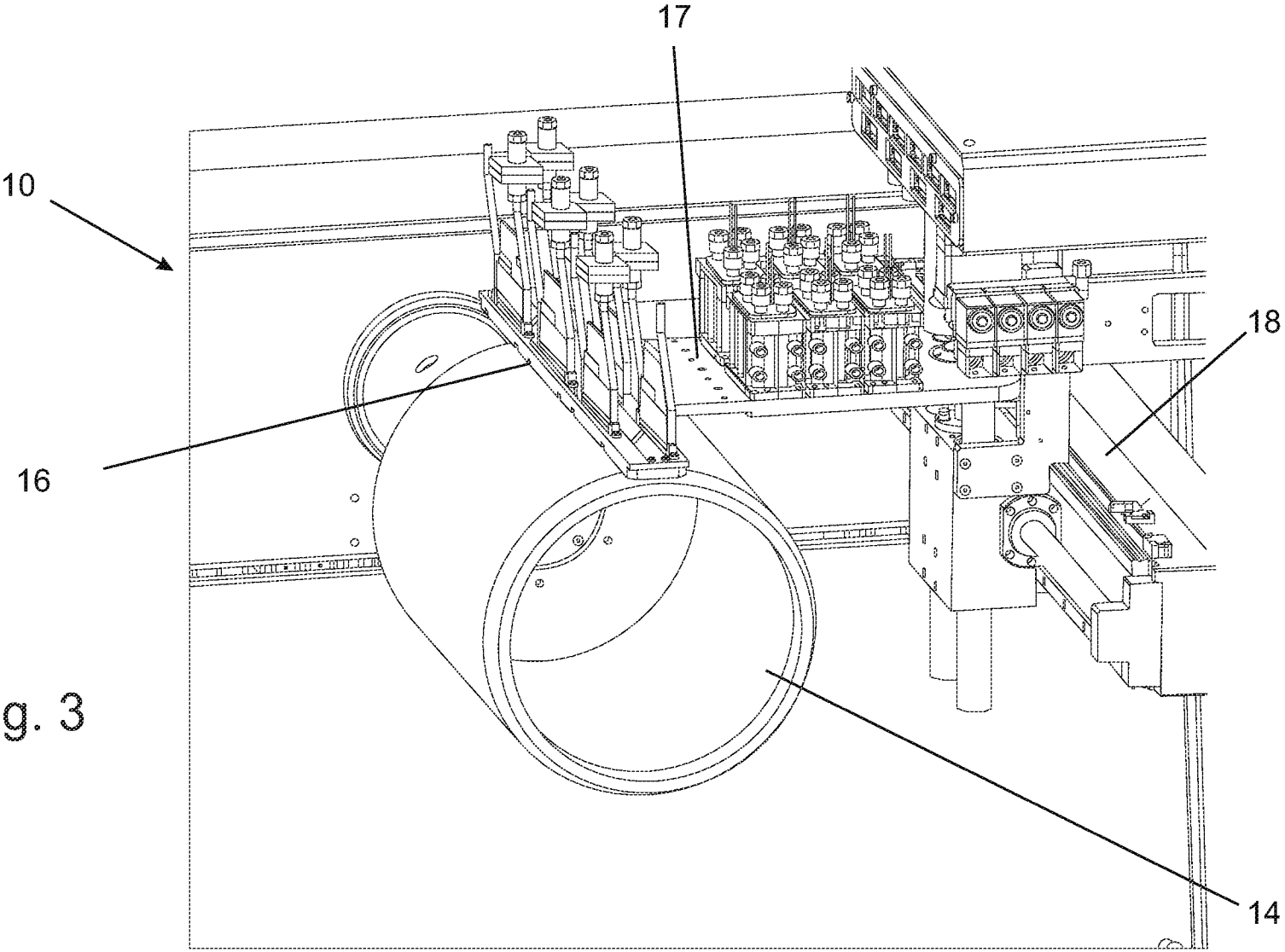
FIG. 3 is a simplified diagram of a view from the front of the printing machine of FIG. 2.

FIG. 3 is a schematic front view of the textile printing machine of FIG. 2. As discussed, the nozzles and linear nozzle arrays align along the axial direction of drum 14 and the head may be adjusted to maintain a constant printing distance irrespective of the size of drum or type of fabric.

Figure 4:
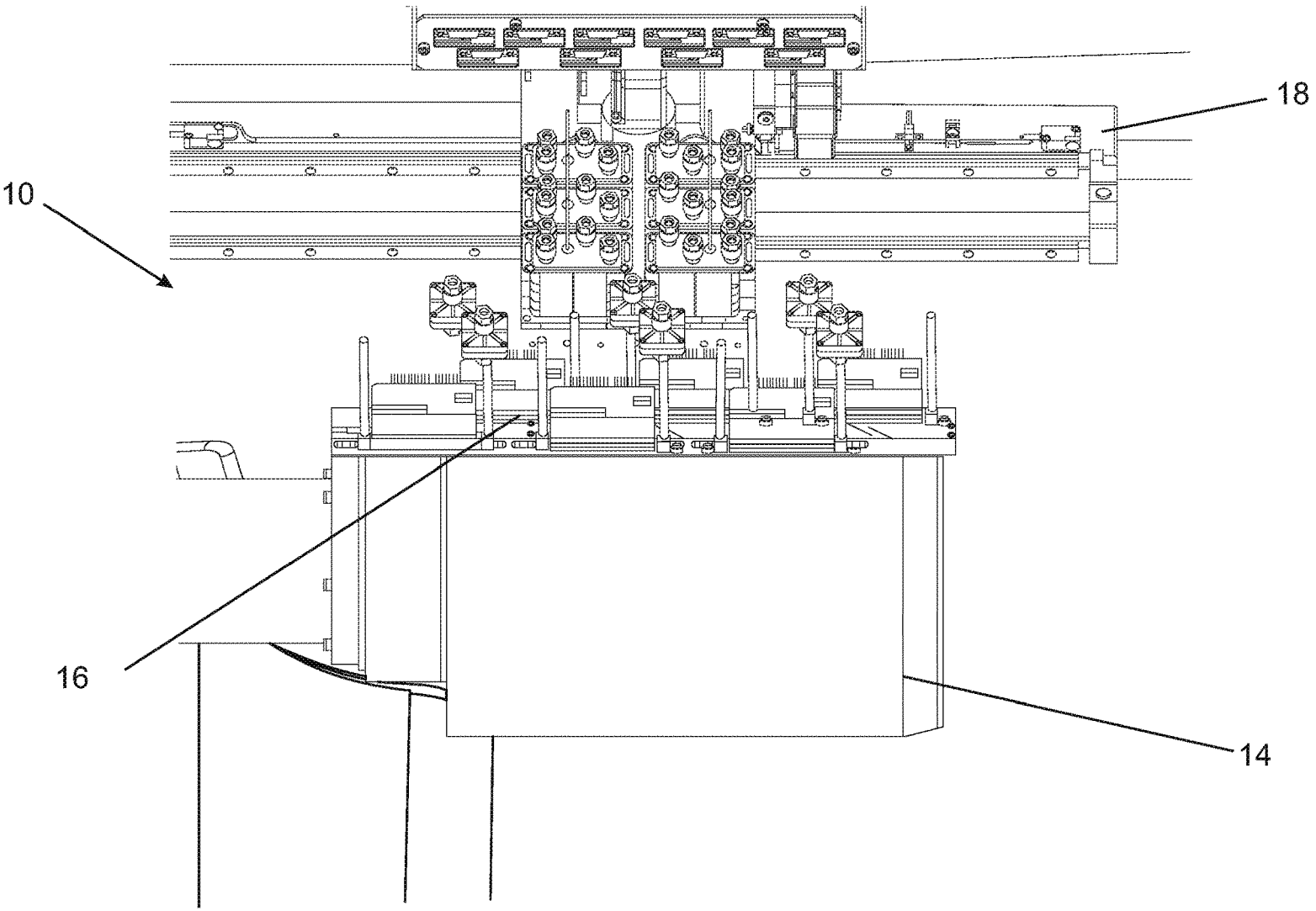
FIG. 4 is a simplified diagram of a view from the print drum side, of the printing machine of FIG. 2.

FIG. 4 is a schematic side view from the drum side of the textile printing machine of FIGS. 1A-D and showing the drum 14 extending in the same axial direction as the arm 18 so that the head 16 rides along the arm and along the length of the drum.

Figure 5:
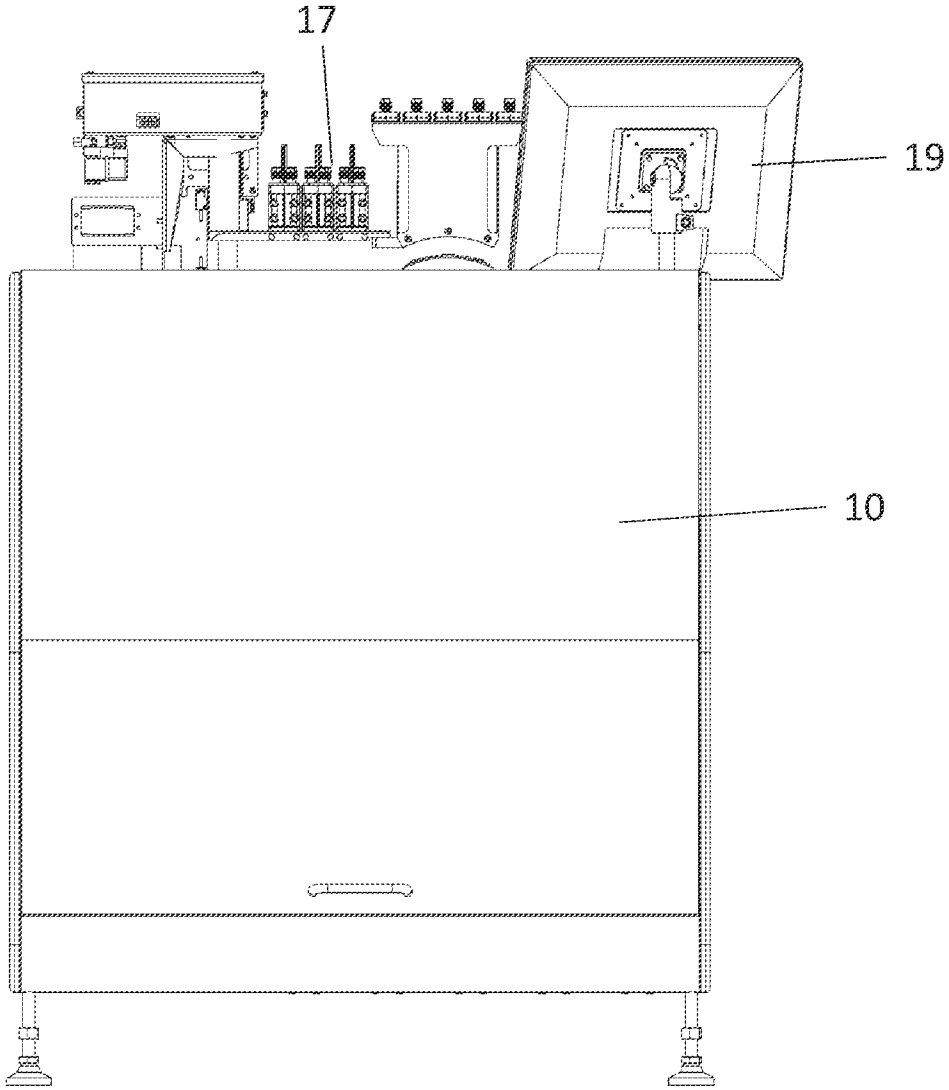
FIG. 5 is a simplified diagram of a view from the rear of the printing machine of FIG. 2.

FIG. 5 is a schematic rear view of the textile printing machine 10 of FIGS. 1A-D. The back of carriage 17 may be seen as well as flat screen 19.

Figure 6:
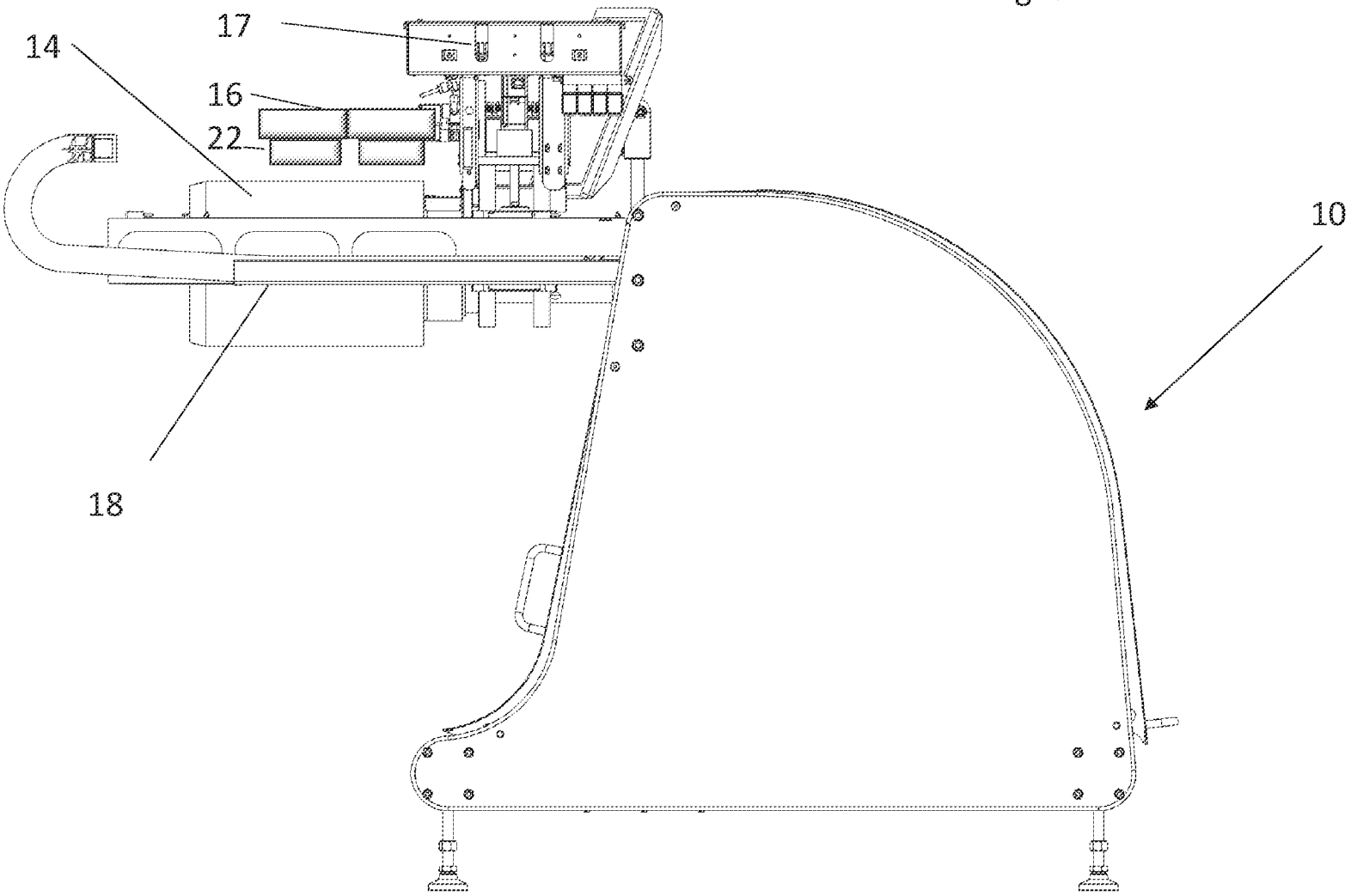
FIG. 6 is a simplified diagram of a view from the support arm side, of the printing machine of FIG. 2.

FIG. 6 is a schematic side view from the arm side of the textile printing machine of FIGS. 1A-D. In FIG. 6, the print head 16 may be seen to be mounted on carriage 17 which in turn is mounted on the arm 18 in order to travel the length of the arm during the printing operation. Separate nozzle arrays 22 extend along the axial length of the drum.

Figure 7:
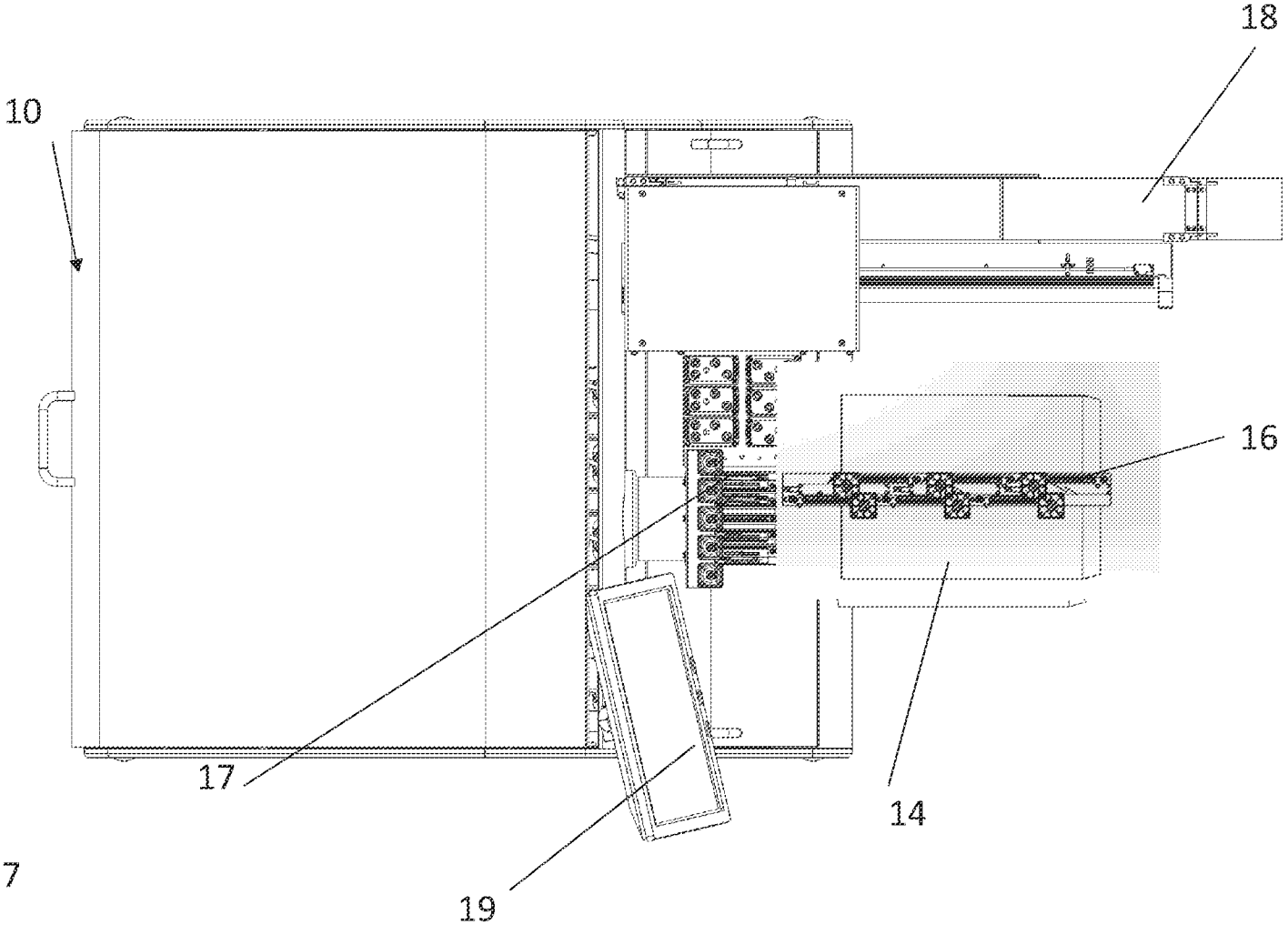
FIG. 7 is a simplified diagram of a view from above of the printing machine of FIG. 2.

FIG. 7 is a schematic view from above of the textile printing machine 10 of FIGS. 1A-D showing the print head 16, made up of three linear nozzle arrays, held by carriage 17 in its initial position over drum 14 before it has begun travelling along the axial length of the drum 14. As discussed above, the carriage rides along arm 18.

Figure 8:
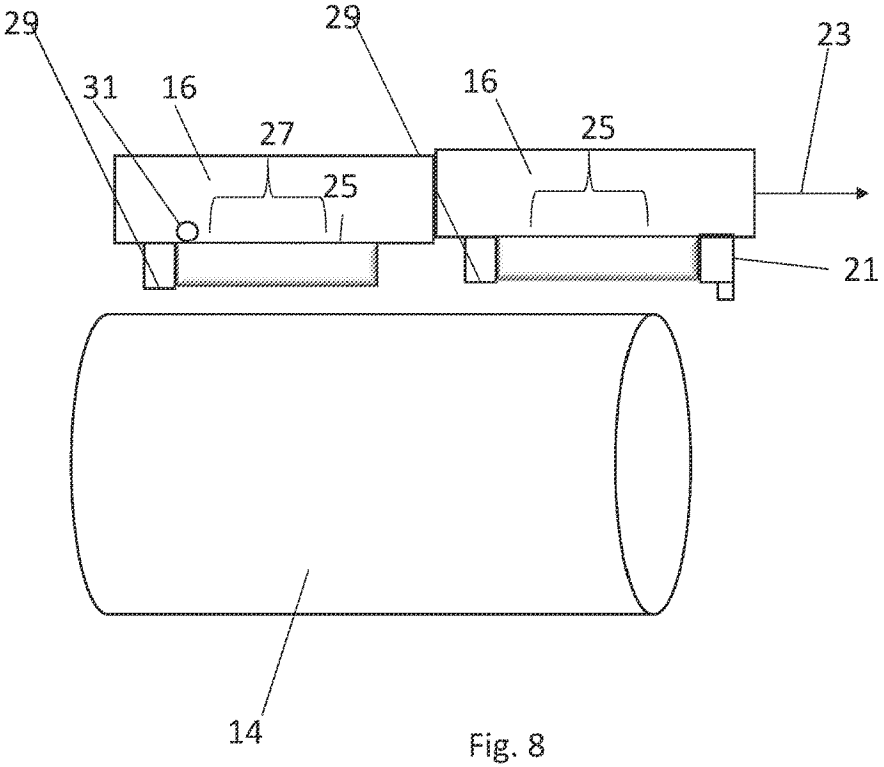
FIG. 8 is a simplified diagram showing a print head from the side, in a view similar to that of FIG. 1C, in an embodiment of the present invention including a wrinkle detector, pre-treatment nozzle and post treatment nozzle.

Reference is now made to FIG. 8, which is a side view of drum 14 with print head 16 in a printing position located above the drum. The print head includes two linear nozzle arrays. Arrow 23 indicates the relative direction of travel of the print head over the drum. A wrinkle detector 21 is located in front of the first nozzle array to detect wrinkles in the fabric. Wrinkles that are large enough to reach the nozzles may block the nozzles from expelling ink or cause other damage. The result is that ink that fails to be expelled may remain in the nozzle and dry, thus blocking the nozzle and rendering the nozzle useless. The wrinkle detector looks for wrinkles in the fabric that are big enough to reach across the printing distance and block the nozzles. If such a wrinkle is found then printing may be stopped. The wrinkle detector may be implemented in a number of ways, including using a comb of very light wires, say of the kind used as acupuncture needles, as these are light enough to be deflected by the lightest of fabrics. When the wires are deflected by a wrinkle, a circuit is either made or broken. Alternatively, a laser beam wrinkle detector may be used, in which wrinkles break the beams.

A pre-treatment array of nozzles 25 may be used to wet the fabric prior to printing. Wetting may prevent leaching of the inks and thus provides for a higher definition of print. In addition the wetting agent may include compounds for balancing pH for the specific inks used etc. There may be more than one pre-treatment nozzle or nozzle array, say for fixation. The second array 27 may provide a white background, which is useful for color printing on dark fabrics, and the colors themselves. Additional nozzles arrays, not shown, may provide the other colors and finally a post-treatment nozzle array may supply post-treatment substances such as coatings and softeners. There may be more than one post-treatment nozzle array. The nozzles may all be aligned along the axial direction of drum 14.

Radiation source 31 may be provided behind the nozzles 27 as shown, or behind the post-treatment nozzle, to provide a curing beam. The radiation source may be a source of infra-red (IR) radiation, or UV radiation or any other suitable beam that the ink is designed for.

Figure 9:
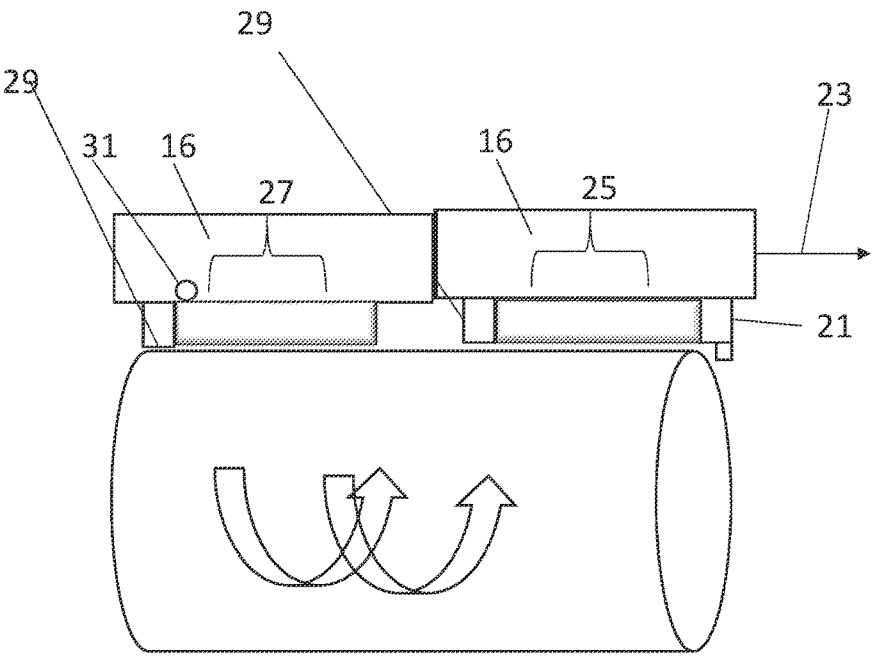
FIG. 9 is a simplified diagram showing the embodiment of FIG. 8 with spiral motion of the print head relative to the print drum indicated.

Reference is now made to FIG. 9 which is the same as FIG. 8 and illustrates the rotation of the drum. In one embodiment the print head advances by one position, one position being one row of pixels. The drum does a complete rotation and one row is pretreated, while succeeding rows receive specific colors and the final row or rows receive the post treatment. Then the print head advances again and the drum carries out a further rotation.

In an alternative embodiment, the print head continues to advance while the drum is rotating. The resultant motion is a spiral over the drum and for high definition printing the motion is programmed with the constraint that every nozzle or nozzle array or set—per color—passes over every pixel of the printing area, and this may be achieved by moving the drum over one rotation in the time that one nozzle array advances by one length. For higher resolution the drum may rotate twice or more for one length of advance of the nozzle array.

Figure 10A:
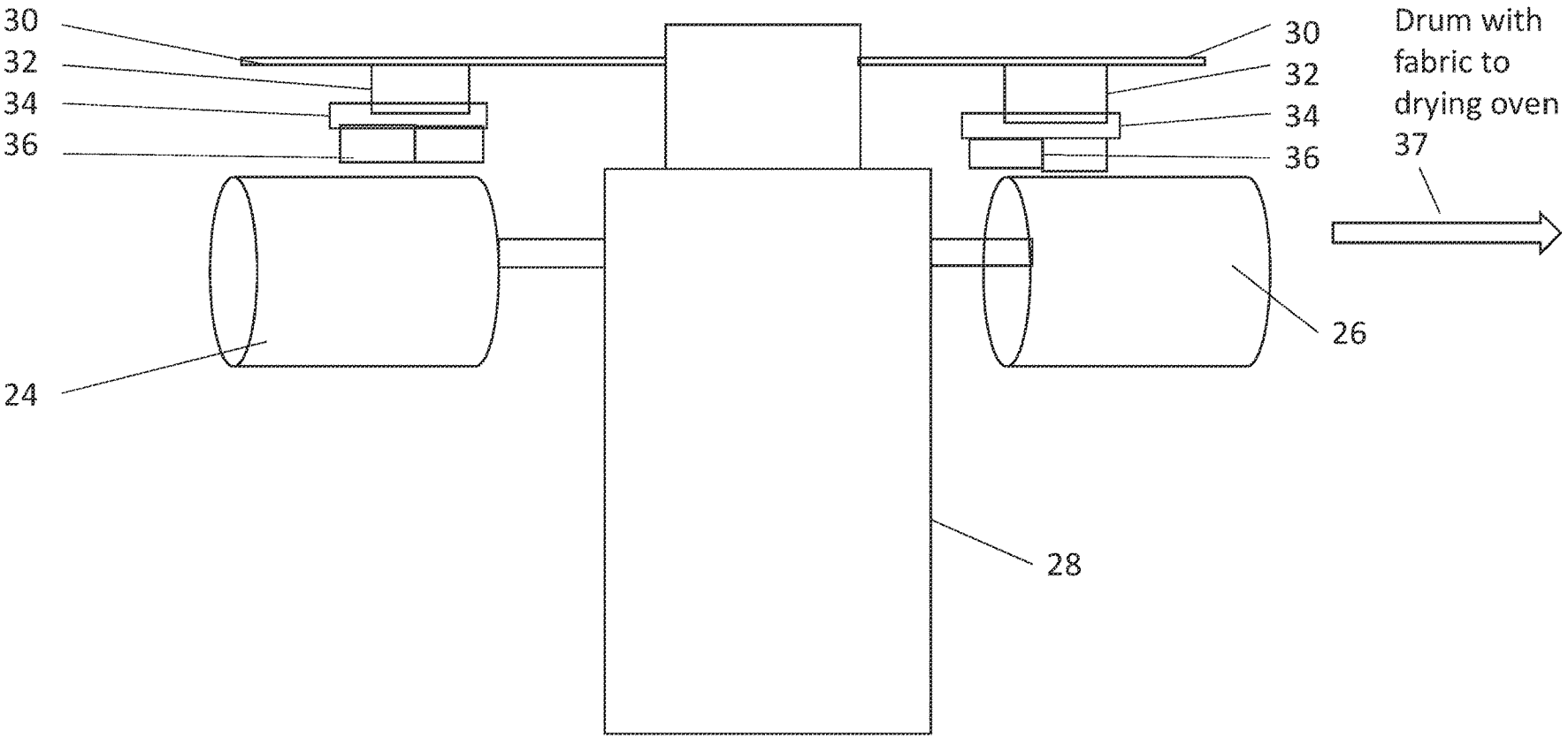
FIG. 10A is a simplified diagram showing a variation of the machine of FIG. 2 having a second print drum axially aligned with the first print drum and indicating how the entire drum with the fabric may be removed for drying.

Reference is now made to FIG. 10A, which is a schematic diagram of another textile printing machine in which a pair of drums 24 and 26 are provided on a common axis on a printing machine 28. Bridges, or rails, 30 hold carriages 32 which in turn hold print heads 34 having nozzle arrays 36 aligned along the axis. In the figure, each drum has its own print head, but rail 30 may be continuous and a single print head may be provided for both drums.

Arrow 37 indicates that the drum as a whole with the fabric still mounted thereon, may be removed from the printer and placed in a drying unit for drying. No separate unloading and reloading of the fabric is needed and the drum may rotate within the drying unit or drying oven in order to obtain even results.

Figure 10B:
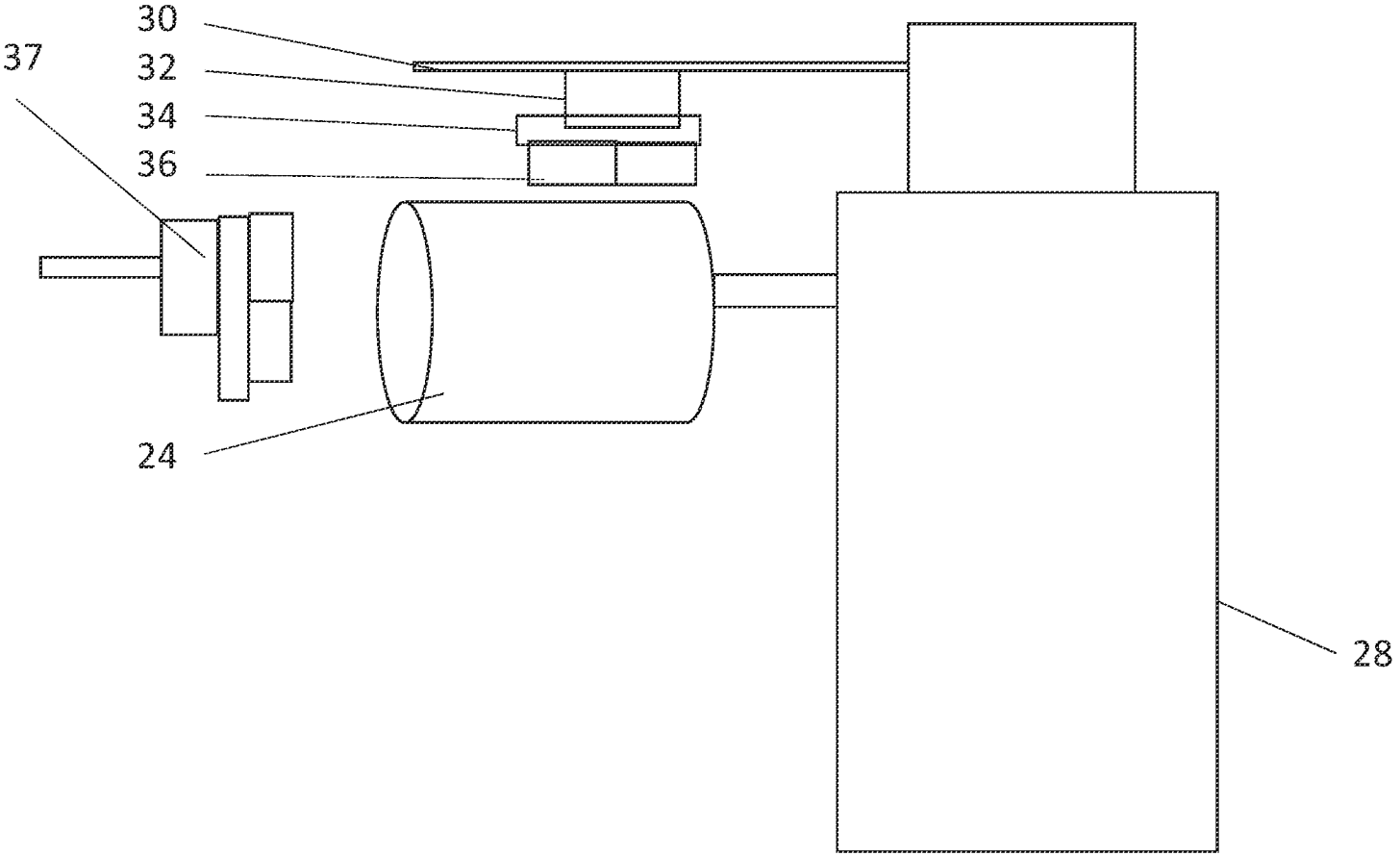
FIG. 10B is a simplified diagram showing a variation of the machine of FIG. 2 in which an additional print head is placed opposite the end of the cylinder.

Reference is now made to FIG. 10B which shows an embodiment in which a drum 24 is provided on printing machine 28. A bridge, or rail, 30 hold carriage 32 which in turn hold print head 34 having nozzle arrays 36 aligned along the axis. In addition a second print head 37 is provided in axial alignment with the end of the drum to print parts of a garment that closes over the end of the drum. Thus for example, tube garments with closed ends, such as socks, may be printed, and printer 37 may print the toe end part of the sock.

Figure 11A:
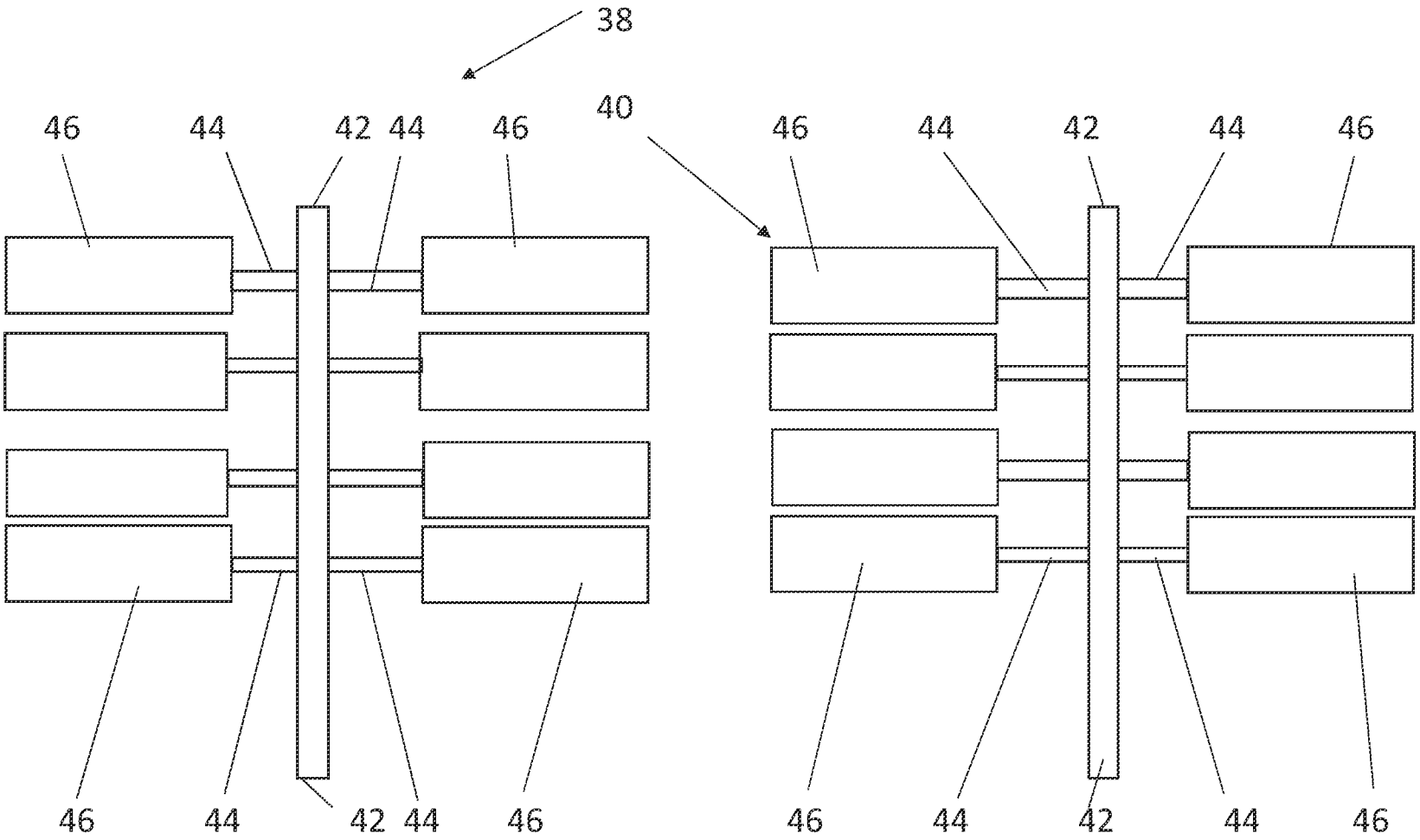
FIG. 11A is a simplified diagram showing two multi-drum palettes side by side for use in a variation of the printing machine of FIGS. 10A-B.

Reference is now made to FIG. 11A, which illustrates a pair of palettes 38 and 40. Each palette has a central stem 42 and branches 44 on either side of the stem. On each branch is a drum 46. In an embodiment, oppositely facing branches are aligned so that at least two drums line up on a single rotation axis. The palettes 38 and 40 are loaded separately and then moved to the printing position for printing at the drums. In the case of two or more palettes being positioned side by side, branches on one palette may line up with branches on the next palette, so that a single rail may service four or more drums. Thus the number of print heads needed can be reduced. Four branches are shown on each side purely by way of example. The total numbers of branches and drums may be set according to the size of the printing machine, the size of the largest drum needed, and according to need. Furthermore the number of pallets may be increased, again according to need.

For the purpose of drying the fabrics after printing, the entire palette may be entered into a drying oven with no need to unload and reload the fabrics as is done today.

Figure 11B:
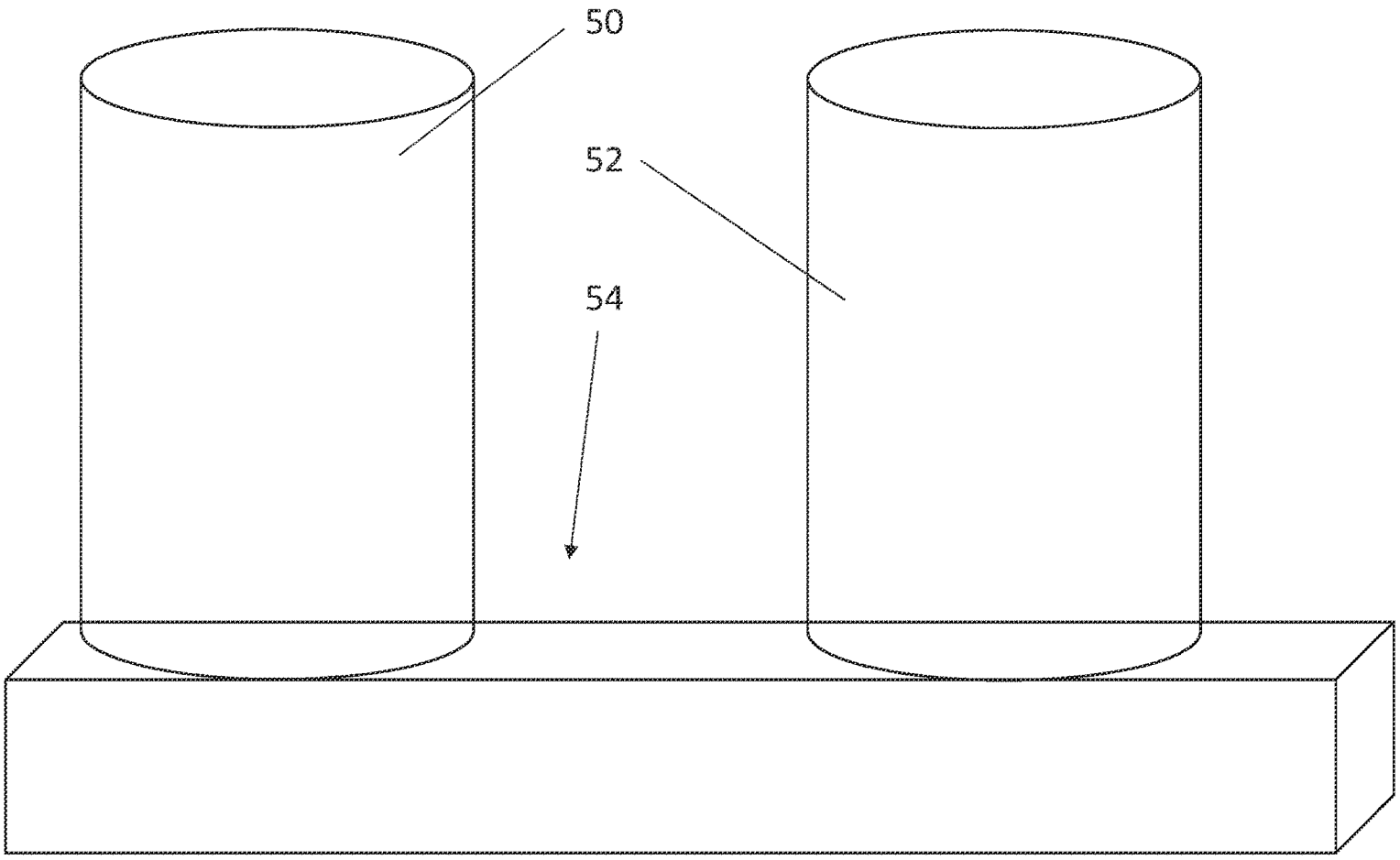
FIG. 11B is a simplified diagram showing two drums side by side in a variation of the printing drum of FIG. 2.

Reference is now made to FIG. 11B, which shows two drums 50 and 52 side by side on machine 54. The multiple pallets of FIG. 11A are particularly suitable for small garments such as socks. For larger garments such as bodysuits and leotards, the drums are body size and thus making pallets may not be feasible. Nevertheless, in order to improve throughput, drums may be provided side by side.

The machine may be built in units, for example with one unit taking a single drum or one unit taking a palette. In this way, units can be built up to make machines of any desirable size and capacity.

Figure 12:
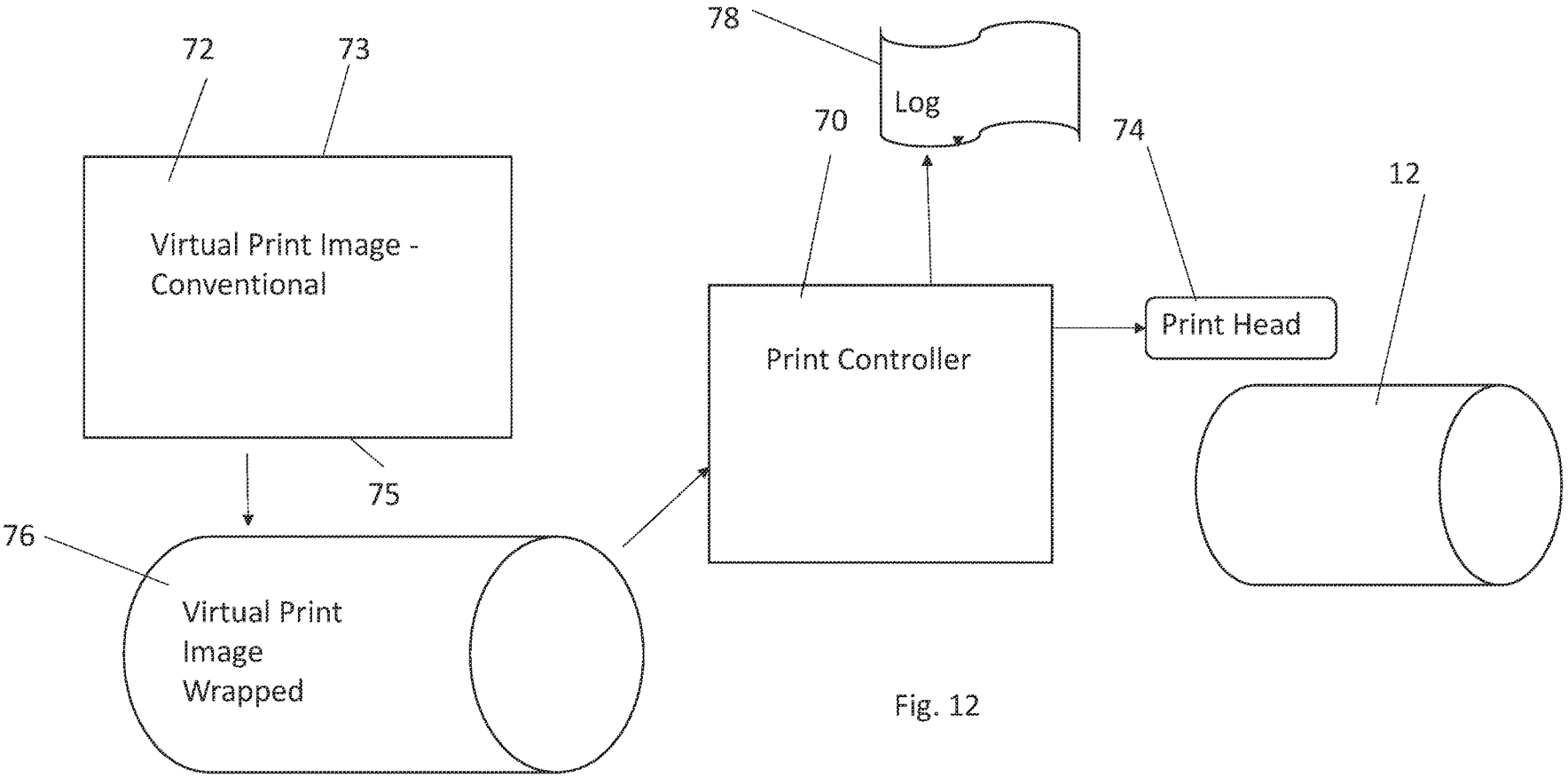
FIG. 12 is a simplified diagram showing how a conventional flat printing image may be converted into a tubular printing image for control of the print head of the present embodiments.

Reference is now made to FIG. 12, which illustrates control of the print head of the present embodiments. Conventionally, a print controller 70 uses a virtual print image 72 to map out the pixels to be printed by print head 74, and the controller reaches each pixel with the print head and consults the virtual image for the color to print at the pixel. However in the case of tube 12, opposite sides of the image are joined and it would be unsightly to have a discontinuity in the printing image where the edges of the virtual print image are crossed.

Thus, in accordance with the present embodiments, the conventional virtual printing image may be projected onto a 3D cylinder shape 76 by wrapping the image so that the opposite edges 73 and 75 are brought together. Optionally, both automatic and manual image processing techniques can be used to ensure that there is no discontinuity in the image, so that patterns match up across the boundary etc. That is to say it may be ensured that the image is continuous around the cylinder. Thus the virtual 3D shape may serve as the printing map for print controller 70.

The controller 70 may keep a log 78 of operations, in particular including numbers and times of printing operations as well as diagnostic and failure information.

Figure 13:
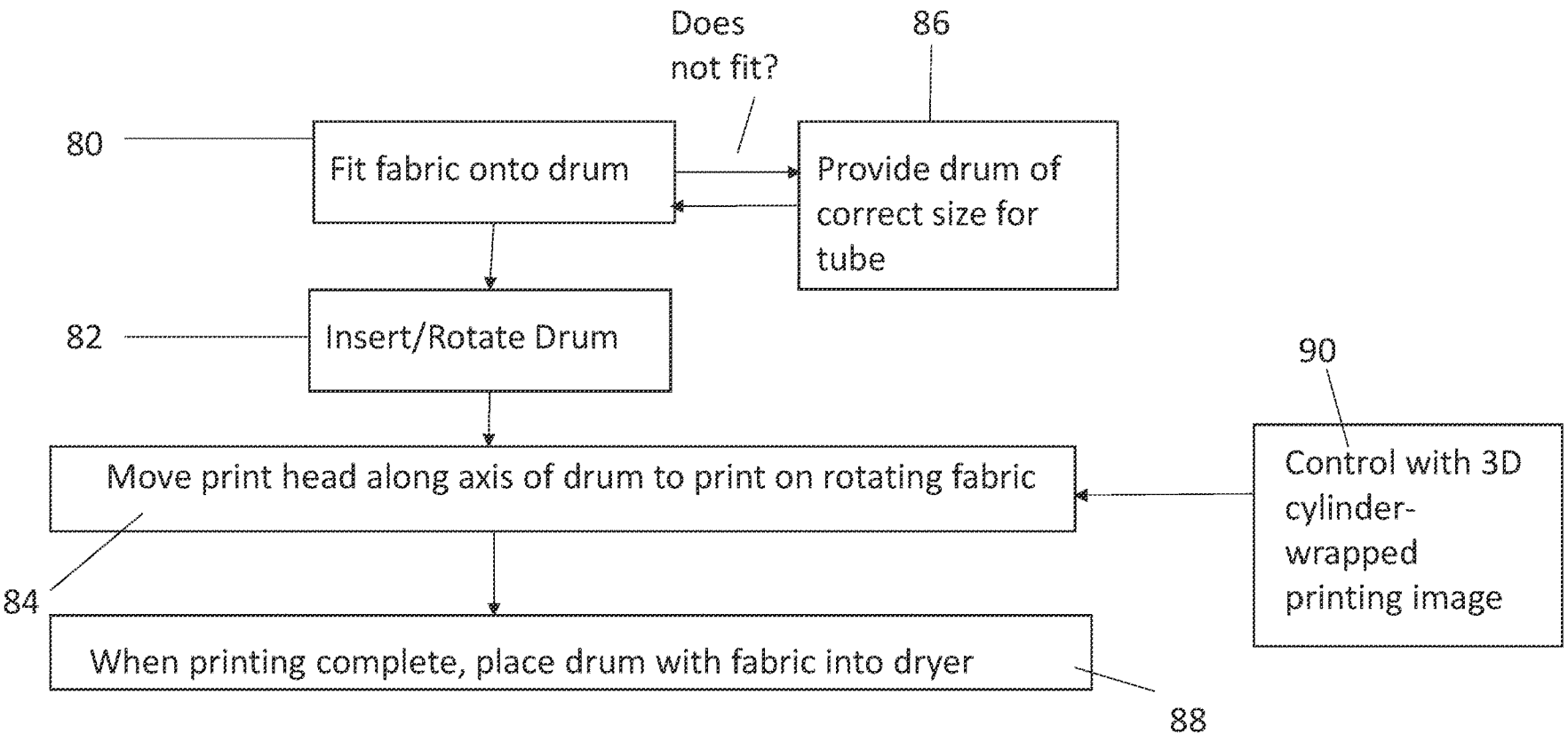
FIG. 13 is a simplified flow chart illustrating the printing of a fabric on a single drum according to embodiments of the present invention.

Reference is now made to FIG. 13, which is a simplified diagram illustrating a method of printing a seamless fabric, which method may be used with the printing machines explained in respect of FIGS. 1A to 12. Box 80 indicates fitting the fabric over a drum. In box 82 the drum with the fabric fitted is rotated, and in box 84 the print head moves axially along the drum to print lines along the fabric.

As discussed, the print head is made up of print nozzles, and the nozzles may be aligned along the axial direction of the drum so that all of the nozzles are at substantially the same distance from the fabric on the drum.

In general the fabric should be taut for printing, as wrinkles etc. can disrupt the final results. Thus different sized tubes may require different sized drums. This if the current drum does not fit it may be exchanged with a drum of a different size, as indicated by box 86. The nozzles are arranged axially along the drum and thus do not need to be realigned for the curvature of the new drum, although the height of the print head may need to be adjusted to give the correct printing distance.

Thus the user may select, from a set of drums that are provided, the most suitable fit for a given fabric.

As indicated by box 90, the print head may be controlled to print via a virtual printing image that is cylindrical, and which may be formed by wrapping an image onto the cylinder in such a way that the image is continuous. Referring again to FIG. 12, and the virtual image comprises first and second oppositely facing edges 73 and 75 that are brought into contact during the wrapping operation onto the cylinder to form 3D virtual print image 76. The wrapping operation may optionally include carrying out image processing to remove discontinuities between said first and second sides that are brought into contact.

As indicated by box 88, after printing, the drum with the fabric still mounted on it may be placed in a dryer. In the case of a palette of drums the entire palette may be placed in a suitable dryer and unloaded afterwards.

Reference is now made to FIG. 14 which shows two drums, 100 and 104, which are modified for hanging in the drier or oven with the garment to be dried. Drum 100 has hanging cord 102 which may be attached to a hook in the oven. Drum 104 has hook 106.

Reference is now made to FIGS. 15-18, which are simplified diagrams illustrating an embodiment of the present invention designed for garments that are too large for the main drum. In this case, garment length 106 is too long for drum 108. In the previous embodiments the only option was to replace the drum with another larger drum. However, in the present embodiments, there is provided a secondary drum 110 placed on arm 112 which extends from shaft 114, and garment 106 is stretched between drum 108 and secondary drum 110. Preferably both drums rotate. The length of arm 112 may be adjustable to allow for correct fitting of the garment, as shown in FIGS. 17 and 18, where secondary drum 110 is secured by tightening a screw at a desired height in slot 118. Alternatively or additionally, or a range of different length levers may be available.

Lever 112 may be attached to shaft 114 using a ring 116, which may fix the orientation of the lever 112 with respect to the shaft.

With any of the embodiments, it is noted that a garment such as a shirt or t shirt or a pullover or the like may be placed on the drum. In the case of a shirt the buttons may be closed and then the shirt or pullover may be printed on front and back. In this way continuous printing from front to back may be carried out, and the design or image being printed may be continuous from front to back.

In the following, embodiments are described which are dedicated to printing flat items.

FIG. 19 illustrates a garment to be wrapped onto a drum for printing, according to embodiments of the present invention. Garment 210 is a simple shirt and is placed on backing or foil 212. The backing or foil 212 may be either underneath or inside the garment. Edge 214 of the backing extends outwardly of the shirt. Although the shirt is shown as a closed shirt, the shirt may be a buttoned shirt or may be a fully open garment.

Reference is now made to FIG. 20 which illustrates a rotary drum 220 for a textile printer according to embodiments of the present invention. Drum 220 is a cylinder having a length 222 between two rounded ends 224 and 226. A groove 228 extends along length 222 of the cylinder, and the groove is arranged as a catch for catching on to any flat edges that it meets during rotation, such as the backing or foil edge 214. As the drum rotates, the catch grabs the edge and pulls the foil round with the effect that the garment is wrapped around the drum. As shown in the figure, rotation is counter-clockwise as per arrow 230.

Reference is now made to FIG. 21, which is a simplified schematic cross-section of the drum 220 of FIG. 20, particularly showing an exemplary internal structure of groove 228. The groove contains or is constructed as a directional catch, designed to allow easy entry of an edge of the garment or backing as the groove approaches during rotation. The catch may prevent exit of the edge when receding in the same rotation direction and thus drag the edge around with the drum.

In FIG. 22 the rotation direction is clockwise, as illustrated by arrow 232.

The groove 228 is made up of a proximal edge 234 and a distal edge 236, where the term proximal is used to indicate the edge that arrives first when rotating in the rotation direction. The proximal edge is rounded in such a way that it recedes radially inwardly into the depth of the drum into U-shaped holder 238. U-shaped holder 238 continues the inward curve at the proximal end of the groove and has a far end 240 which may be aligned with the distal edge 236 of the groove. The distal edge 236 comprises a rounded surface facing towards the proximal end which extends radially outwardly from the drum to extend beyond the drum circumference. The rounding of the distal end is such as to push inwards into the drum any edge that it meets while rotating. That is to say the distal end of the drum is rounded to present a slope from above to push the edge downwardly into the drum, and in particular at the radial height of the circumference of the drum the distal end presents an inward slope. The edge is either trapped within the U-shaped holder or between the distal edge and the U-shaped holder at an angle which is at or more than ninety degrees, and the sharp angle thus traps the edge. Thus the groove forms a directional catch and anything connected to the edge is dragged around the drum as discussed above.

The rounding of the distal end forms into a second U-shaped holder 241 along the circumferential direction of the drum and with the body of the U facing away from the proximal end. The U-shaped holder 241 may hold the far end of the foil following wrapping around the drum.

Reference is now made to FIG. 22, which shows the internal space of the drum seen from the open end. A garment 240 sits on foil 242 which wraps around the circumference of the drum. One end of the foil sits in the U-shaped holder 238 while the other end of the foil is held in the second U-shaped holder 241. The drum rotates around central axis 243.

FIG. 23 is a perspective view of the drum in FIG. 22 showing the foil 242 wrapped around the drum.

Reference is now made to FIG. 24, which illustrates the drum of FIG. 23 from a different angle, so as to show drive wheel 250 and shaft 252. The drum is driven so as to pick up the shirt from the edge of the backing and wrap the shirt on the drum. The second U-shaped holder 241 extends along the length of the drum in front of groove 228 that leads to the first U-shaped holder 236.

FIGS. 25 and 26 are two different views of the drum 220, with end 244 open, and foil 242 wrapped onto the drum. First U-shaped holder 236 can be seen inside the open end 244. In FIG. 26 the groove 228 is visible behind U-shaped holder 236.

FIGS. 27-29 show three different perspective views of the drum 220 with a cover 246 over the end 244. Cover 246 has a rim 248 which fits over the edge of the drum. Drive wheel 250 allows the drum to be rotated. Second U-shaped holder 241 holds one end of the foil 242. The cap 246 may be put in position after the garment and foil are wrapped onto the drum, and the rim 248 may slide over the edges of the foil to secure the foil and the drum.

Reference is now made to FIG. 30, which illustrates a method of mounting a garment onto a rotary drum for printing. The method includes providing a rotary drum having a groove as discussed above, with a catch built into the groove—270. A backing or foil is applied to the garment—272.

An edge of the backing or foil is extended outwardly from the garment towards the drum—274.

The drum is rotated to catch the edge and pull the garment via the edge, so as to wrap the garment around the drum—276.

Caps or elastic bands may then be inserted over the ends of the drum over the garment to fasten the garment in the wrapped position around the drum—278.

Printing is then carried out the garment while the garment is wrapped on the drum and the drum rotates—280.

It is expected that during the life of a patent maturing from this application many relevant printing methods and printers will be developed and the scope of the term printer is intended to include all such new technologies a priori.

As used herein the term "about" refers to ±10% The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention, and the present disclosure is to be construed as if all possible feature combinations have been explicitly detailed herein.

Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A printing machine for printing fabrics on a drum, the printing machine comprising:

at least one drum rotatable about a drum axis, said drum axis defining an axial direction along said drum, the drum configured to receive a tube of fabric thereon;

a first print head placed in proximity to a surface of said drum, to print onto said tube when said tube is fitted onto said drum; wherein said print head comprises a plurality of printing nozzles, said nozzles being aligned along said drum axial direction; and an additional print head located opposite an end of said drum.

2. The printing machine of claim 1, wherein said at least one rotatable drum is interchangeable with other drums of different circumferences, and wherein said at least one rotatable drum or said print head are adjustable to retain a predefined printing distance of said nozzles from said fabric irrespective of a circumference of a currently used drum or a thickness of said fabric.

3. The printing machine of claim 1, wherein said print head is controlled to print via a virtual printing image that is cylindrical, or wherein said cylindrical printing image is formed by wrapping an image into said cylinder so that the image is continuous.

4. The printing machine of claim 1, further comprising at least one pretreatment nozzle for providing pre-treatment fluid to said fabric prior to printing.

5. The printing machine of claim 1, further comprising at least one post-treatment nozzle or post treatment nozzle array for post treatment of said fabric after printing, or wherein said printing head further includes a radiation source to provide a curing beam.

6. The printing machine of claim 1, further comprising at least one post treatment nozzle or post treatment nozzle array, and wherein said at least one post treatment nozzle or post treatment nozzle array is configured to provide to said fabric at least one of a softener, a curing compound, a stabilizing compound and a coating compound.

7. The printing machine of claim 1, comprising at least one additional print head comprising nozzles axially aligned with said drum in parallel with said first print head, the additional print head being at a same radial distance from said drum as said first print head.

8. The printing machine of claim 1, further comprising a wrinkle detector located in front of said nozzles in a direction in which said fabric approaches said nozzles, the wrinkle detector being configured to stop printing if a protruding fold or wrinkle extending from said fabric is detected approaching said nozzles that is big enough to cause blockage of one of said nozzles.

9. The printing machine of claim 1, comprising one member of the group consisting of:

a plurality of rotating drums, a palette of rotating drums, rotating drums arranged in pairs, each pair sharing an axis of rotation, pairs of palettes, each pair of palettes sharing respective axes of rotation, pairs of palettes, each pair of palettes sharing respective axes of rotation, having a print-head-bearing bridge for each of said axes of rotation, said print-head-bearing bridge allowing a single print-head to service drums of multiple palettes, pairs of palettes, each pair of palettes sharing respective axes of rotation, having a print-head-bearing bridge for each of said axes of rotation, said print-head-bearing bridge allowing a single print-head to service drums of multiple palettes, wherein at least one of said print-head-bearing bridges bears a plurality of print-heads, and pairs of palettes, each pair of palettes sharing respective axes of rotation, having a print-head-bearing bridge for each of said axes of rotation, said print-head-bearing bridge allowing a single print-head to service drums of multiple palettes, wherein at least one of said print-head-bearing bridges bears a plurality of print-heads, wherein one palette of at least one pair of palettes is in a loading position for loading fabrics while a second palette of said at least one pair is in a printing position.

10. The printing machine of claim 1, comprising one member of the group consisting of:

a drier unit for drying said fabrics after printing, wherein said drums or said palettes with said drums mounted thereon, and said fabrics on said drums, are inserted into said drying unit;

modular units combined together, wherein each unit has one member of the group consisting of one drum, one pair of drums, one palette of drums and one pair of palettes of drums; a secondary drum, arranged at a preset distance from the first drum, to hold a given fabric taut between the two drums; and a plurality of print heads, said print heads having a linear nozzle array for each color being printed, the printing machine being configured to print by rotating said drum while said print head is stationary or while said print head moves along said axial direction.

11. The printing machine of claim 1, comprising a second print head over said at least one drum at an angle radially separated from said first print head, nozzles of said second print head being axially aligned along said drum.

* * * * *